US007738819B2

(12) United States Patent
Honda et al.

(10) Patent No.: US 7,738,819 B2
(45) Date of Patent: Jun. 15, 2010

(54) IMAGE FORMING METHOD AND APPARATUS, AND DEVELOPING DEVICE AND PROCESS CARTRIDGE THEREFOR

(75) Inventors: Takahiro Honda, Numazu (JP); Hiroyuki Fushimi, Numazu (JP); Shuuichi Endoh, Kamakura (JP); Masato Iio, Yokohama (JP); Shinya Tanaka, Ota (JP)

(73) Assignee: Ricoh Company Limited, Tokyo (JP)

( * ) Notice: Subject to any disclaimer, the term of this patent is extended or adjusted under 35 U.S.C. 154(b) by 1063 days.

(21) Appl. No.: 11/407,368

(22) Filed: Apr. 20, 2006

(65) Prior Publication Data

US 2006/0245794 A1 Nov. 2, 2006

(30) Foreign Application Priority Data

Apr. 28, 2005 (JP) ..... 2005-131109
Apr. 28, 2005 (JP) ..... 2005-131712
Apr. 28, 2005 (JP) ..... 2005-133497

(51) Int. Cl.
*G03G 15/08* (2006.01)

(52) U.S. Cl. ..... 399/263; 399/259

(58) Field of Classification Search ..... 399/159, 399/263

See application file for complete search history.

(56) References Cited

U.S. PATENT DOCUMENTS 4,762,763 A 8/1988 Nomura et al.
4,841,331 A 6/1989 Nakayama et al.
4,933,250 A 6/1990 Nakayama et al.
4,945,022 A 7/1990 Nakayama et al.
4,980,258 A 12/1990 Aoki et al.
5,061,588 A 10/1991 Fushimi et al.
5,418,103 A 5/1995 Muto et al.
5,851,716 A 12/1998 Kuramoto et al.
5,946,536 A * 8/1999 Suzuki ..... 399/286
6,004,715 A 12/1999 Suzuki et al.

(Continued)

FOREIGN PATENT DOCUMENTS

JP 2000-227676 8/2000

(Continued)

OTHER PUBLICATIONS

English translation of JP 2001-117474 published Apr. 2001.*
U.S. Appl. No. 12/047,807, filed Mar. 13, 2008, Honda, et al.

*Primary Examiner*—Mark F Huff
*Assistant Examiner*—Peter L Vajda
(74) *Attorney, Agent, or Firm*—Oblon, Spivak, McClelland, Maier & Neustadt, L.L.P.

(57) ABSTRACT

An image forming apparatus including an image bearing member and a developing device configured to develop an electrostatic image on the image bearing member with a toner to form a toner image thereon and including a developing unit configured to develop the electrostatic image, and a toner cartridge configured to supply the toner to the developing unit through at least one opening, wherein the developing device circulates the toner between the toner cartridge and the developing unit through the at least one opening, and wherein the internal temperature of the hopper is higher than that of the cartridge and the ratio of a charge quantity distribution parameter of the toner under a condition of 45° C. and 54% RH to that under a condition of 25° C. and 54% RH is greater than 0.9 and less than 1.5.

32 Claims, 14 Drawing Sheets

U.S. PATENT DOCUMENTS

| | | | | |
|---|---|---|---|---|
| 6,074,794 | A | 6/2000 | Fushimi et al. | |
| 6,103,441 | A | 8/2000 | Tomita et al. | |
| 6,168,894 | B1 | 1/2001 | Aoki et al. | |
| 6,733,939 | B2 | 5/2004 | Nanya et al. | |
| 6,818,370 | B2 | 11/2004 | Uchinokura et al. | |
| 2003/0175051 | A1* | 9/2003 | Sato et al. | 399/260 |
| 2003/0190540 | A1* | 10/2003 | Shoshi et al. | 430/78 |
| 2004/0146795 | A1 | 7/2004 | Emoto et al. | |
| 2004/0209181 | A1 | 10/2004 | Higuchi et al. | |
| 2005/0003289 | A1 | 1/2005 | Fushimi et al. | |
| 2005/0100355 | A1* | 5/2005 | Suzuki et al. | 399/27 |
| 2005/0112488 | A1 | 5/2005 | Yamada et al. | |

FOREIGN PATENT DOCUMENTS

| | | | |
|---|---|---|---|
| JP | 2001-117474 | * | 4/2001 |
| JP | 2002-91142 | | 3/2002 |
| JP | 2002-162817 | | 6/2002 |
| JP | 2003-280256 | | 10/2003 |
| JP | 2004-354530 | | 12/2004 |

* cited by examiner

IMAGE FORMING METHOD AND APPARATUS, AND DEVELOPING DEVICE AND PROCESS CARTRIDGE THEREFOR

BACKGROUND OF THE INVENTION

1. Field of the Invention

The present invention relates to an electrophotographic image forming apparatus and an electrophotographic image forming method. In addition, the present invention also relates to a developing device and a process cartridge for the image forming apparatus.

2. Discussion of the Background

Electrophotographic image forming methods typically include the following processes.

(1) An electrostatic image is formed on an image bearing member such as photoreceptors (electrostatic latent image forming process);

(2) The electrostatic image is developed with a developer including a toner to form a toner image on the image bearing member (developing process);

(3) The toner image is transferred to a receiving material optionally via an intermediate transfer medium (transfer process); and (4) The toner image is fixed on the receiving material (fixing process).

The developers are broadly classified to two component developers which include a toner and a carrier, and one-component developers (such as one-component magnetic developers and one-component non-magnetic developers) which include no carrier and which consist essentially of a toner.

In two-component developing methods, toner particles tend to be fixedly adhered to the surface of carrier particles after long repeated use. In this case, the properties (such as charging ability) of the carrier particles deteriorate. In addition, since only the toner is used for developing electrostatic images, the toner concentration in the developer decreases with time, and therefore a device for controlling the toner concentration is necessary. Therefore, image forming apparatus using a two-component developing method become large in size.

In contrast, one-component developing methods do not have such drawbacks and therefore it is possible to miniaturize image forming apparatus. In addition, one-component developing methods have another advantage such that the image forming apparatus using the methods can be used under various environmental conditions (from low temperature/low humidity conditions to high temperature/high humidity conditions). Therefore, one-component developing methods are mainly used now.

One-component developing methods are classified into one-component magnetic developing methods using a magnetic toner and one-component non-magnetic developing methods using a non-magnetic toner.

In one-component magnetic developing methods, a thin layer of a magnetic toner, which includes a magnetic material (such as magnetite), is formed on a developing sleeve including a magnet therein using a thickness controlling member (such as blades). Therefore, recently the magnetic one-component developing methods are widely used for small-sized printers.

In contrast, non-magnetic toners for use in the one-component non-magnetic developing methods have no magnetic force. Therefore, in one-component non-magnetic developing methods, a thin toner layer is formed using a toner supply roller which presses a toner to a developing sleeve. Therefore, the toner layer is electrostatically borne on the developing sleeve. Since non-magnetic toners do not include a magnetic material, which is typically colored, the non-magnetic toners can be preferably used for forming color images. In addition, since a developing sleeve including no magnet therein can be used, the developing device (i.e., the image forming apparatus) has a light weight and a low cost. Therefore, recently such non-magnetic one-component developing methods are widely used for small-sized full color printers.

Developing devices typically include a developing section configured to develop an electrostatic image on an image bearing member, and a toner cartridge configured to supply a toner to the developing section. These developing devices often cause a problem in that a large amount of toner particles in the developing section are returned to the toner cartridge, thereby decreasing the amount of the toner in the developing section, resulting in formation of abnormal images.

In attempting to solve the problem, published unexamined Japanese patent application No. (herein after referred to as JP-A) 2002-162817 discloses a developing device which includes a developing section configured to develop an electrostatic image on a photoreceptor belt and a toner cartridge configured to supply a toner to the developing section through a connection passage and which can be detachably attached to an image forming apparatus. In this regard, a check valve made of an elastic material is provided on the connection passage to prevent the toner in the developing section from returning to the toner cartridge.

Since the toner in the developing section does not return to the toner cartridge, toner particles with a low charge quantity tend to remain in this developing section after long repeated use. Therefore, problems in that images having undesired image qualities are formed and toner particles are scattered around the developing section tend to occur. Particularly, in one-component non-magnetic developing methods toner particles having a relatively small particle diameter and a relatively high charge quantity are mainly used for developing electrostatic images. Namely, toner particles having a relatively large particle diameter and a relatively low charge quantity tend to remain in the developing section, thereby affecting the image qualities of the toner images.

In attempting to impart a proper charge amount to a toner, JP-A 2000-227676 discloses a technique in that a binder resin having a high acid value is used for the toner. However, this technique has a drawback in that the resultant toner has poor stability to withstand environmental conditions. Specifically, the toner has too large an amount of charge quantity under low temperature and low humidity conditions, and has too small an amount of charge quantity under high temperature and high humidity conditions. Therefore, the toner causes problems such as decrease of image density and formation of background fouling.

JP-A 2004-354530 discloses a technique in that a large amount of charge controlling agent is included in a toner. However, it is hard to disperse a large amount of charge controlling agent in a binder resin. If a charge controlling agent is nonuniformly dispersed in a toner, image qualities tend to deteriorate after long repeated use.

JP-A 2003-280256 discloses a technique in that a proper amount of charge is imparted to a toner without using a charge controlling agent. Specifically, the technique is that a particulate inorganic material is adhered to the surface of toner particles. However, it is difficult to perfectly solve the problems mentioned above (i.e., decrease of the charge quantity of the toner in the developing section) cannot be avoided by using this technique when the toner is repeatedly used in a developing device.

Because of these reasons, a need exists for an image forming apparatus which can produce high quality images by imparting a proper amount of charge to a toner in a developing section even after long repeated use without deteriorating the fluidity of the toner.

SUMMARY OF THE INVENTION

As an aspect of the present invention, an image forming apparatus is provided which includes:

an image bearing member configured to bear an electrostatic image thereon; and a developing device configured to develop the electrostatic image with a toner to form a toner image on the image bearing member, including;

a developing unit configured to develop the electrostatic image, and including a hopper configured to temporarily store the toner supplied from a toner cartridge to the developing unit, and the toner cartridge configured to contain the toner and supply the toner to the developing unit through at least one opening, wherein the developing device circulates the toner by supplying part of the toner in the toner cartridge to the developing unit and returning part of the toner in the developing unit to the toner cartridge through the at least one opening, wherein the developing device may satisfy the following relationship:

$$T_H > T_C$$

wherein $T_H$ represents the internal temperature of the hopper, and $T_C$ represents the internal temperature of the toner cartridge, and the toner satisfies the following relationship:

$$0.9 < CQDP_{45^\circ C.}/CQDP_{25^\circ C.} < 1.5$$

wherein $CQDP_{45^\circ C.}$ and $CQDP_{25^\circ C.}$ represent a charge quantity distribution parameter under a conditions of 45° C. and 54% RH, and a condition of 25° C. and 54% RH, respectively, and wherein the charge quantity distribution parameter CQDP is determined by the following equation:

$$CQDP = \Sigma[(q/d) \times C]/Wh$$

wherein q represents the charge quantity of a particle of the toner in units of femto-coulomb, d represents the diameter of the particle in units of ten micrometers, C represents the number of toner particles having such a charge quantity and a particle diameter, and Wh represents the half width of the charge quantity distribution curve, wherein $7000 < \Sigma[(q/d) \times C] < 12000$ under the conditions.

It is preferable that the toner cartridge includes a rotating member configured to agitate and transport the toner, and a toner return promoting member configured to accelerate to return the toner in the hopper to the toner cartridge by forming a space in the toner cartridge in the vicinity of the at least one opening together with the rotating member, and wherein the toner has a powder wall collapsing angle of from 30 to 70°.

Alternatively, the hopper can include a rotating member configured to agitate and transport the toner, and a toner feed promoting member configured to accelerate to supply the toner in the toner cartridge to the hopper by forming a space in the hopper by contacted with the rotating member, followed by being released from the rotating member, wherein the toner has a powder wall collapsing angle of from 5 to 50°.

As another aspect of the present invention, a developing device is provided. The developing device has the configuration as mentioned above.

As yet another aspect of the present invention, a process cartridge is provided which includes at least the image bearing member and the developing device mentioned above, wherein the process cartridge can be detachably attached to an image forming apparatus as a unit.

As a further aspect of the present invention, an image forming method is provided, which includes the following steps:

forming an electrostatic image on an image bearing member; and developing the electrostatic image with a developing device mentioned above.

These and other objects, features and advantages of the present invention will become apparent upon consideration of the following description of the preferred embodiments of the present invention taken in conjunction with the accompanying drawings.

DETAILED DESCRIPTION OF THE INVENTION

Figure 1:
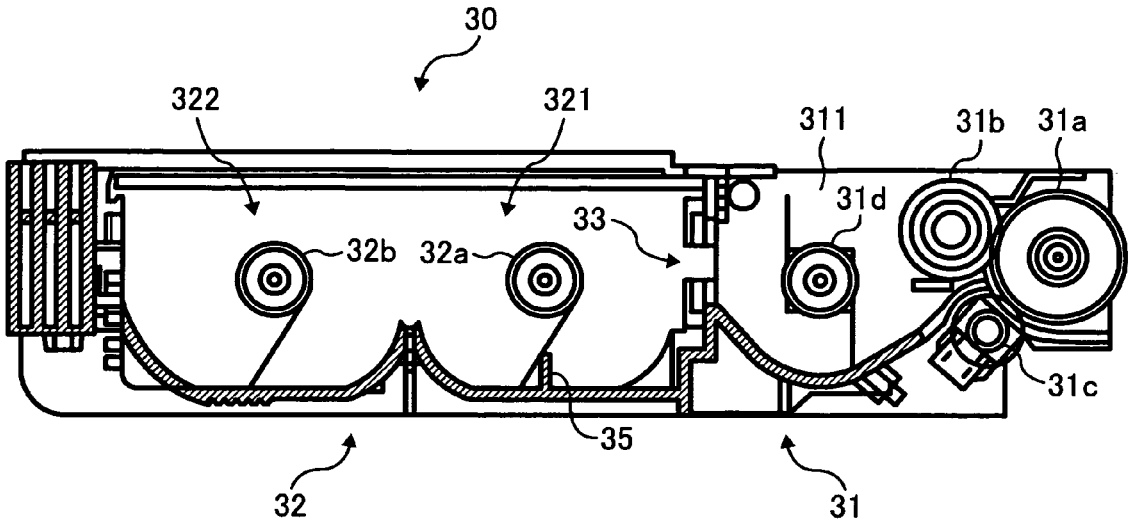
FIG. 1 is a schematic view illustrating an example of the developing device of the present invention.
Figure 2:
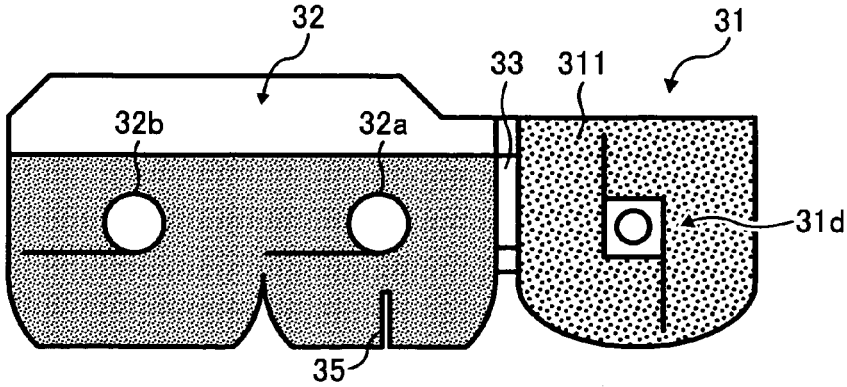
FIG. 2 is a simplified view of the cartridge and the hopper of the developing device illustrated in FIG. 1.

FIG. 1 is a schematic view illustrating a first example of the developing device of the present invention. In addition, FIG. 2 is a simplified view illustrating the toner cartridge and the hopper of the developing device illustrated in FIG. 1.

A developing device 30 includes a developing unit 31 configured to develop an electrostatic image on a photoreceptor (serving as an image bearing member) with a toner (serving as a one-component developer); and a toner cartridge 32 configured to replenish the toner to the developing unit 31.

The developing unit 31 faces a photoreceptor at a developing region, and includes a developing sleeve 31*a* (serving as a developer bearing member) configured to transport the toner to the developing region, a toner supply roller 31*b* configured to supply the toner to the developing sleeve 31*a*, a toner layer thickness control roller 31*c* (serving as a toner layer thickness control member) configured to control the thickness of the toner layer on the developing sleeve 31*a*, and a first paddle 31*d* configured to transport the toner to the toner supply roller 31*b*. The developing unit 31 includes a hopper 311 configured to temporarily store the toner which has been transported from the toner cartridge 32.

The toner cartridge 32 includes first and second toner storage rooms 321 and 322; second and third paddles 32*a* and 32*b* configured to feed the toner to the developing unit 31; and a rib 35 (i.e., a projection) which is arranged on the bottom surface of the first toner storage room 321 of the toner cartridge 32.

As mentioned above, the developing device uses a one-component developer. When a two-component developer is used, it is hard to replace the toner in the two-component developer with a fresh toner. In contrast, when a one-component developer is used, it is easy to replace the developer with a fresh developer because the developer in the toner cartridge 32 is the same as that in the developing unit 31. Therefore, a one-component developer (particularly, a one-component non-magnetic developer) is preferably used for the developing device 30 of the present invention. With respect to one-component non-magnetic developers, the external additives present on the surface of the developers (i.e., toners) largely influence the charging properties and fluidity of the developers. In contrast, the developing properties of one-component magnetic developers can be controlled by controlling the magnetization of the developer which depends on the quantity of the magnetic materials included in the developers. By using a one-component magnetic developer for the developing device 30 of the present invention, the developer can maintain good developing properties for a long period of time because the external additive on the surface of the developer can be maintained without problems such as releasing and embedding of the external additives.

In the developing device 30, the developing unit 31 and the toner cartridge 32 are arranged side by side. One or more openings 33 (i.e., a passage, hereinafter referred to as openings) are formed between the developing unit 31 and the toner cartridge 32 to transport the toner therebetween. Specifically, the toner in the cartridge 32 is transported to the developing unit 31 through the opening 33 to replenish the toner, and in addition, the toner in the developing unit 31, which is deteriorated because of repeatedly used, is returned to the cartridge 32 to be mixed with a fresh toner. The cartridge 32 can be replaced with new one independently of the developing unit.

In the developing unit 31, the toner receives a pressure from the toner supplying roller 31*b* and the toner layer thickness control roller 31*c* and thereby the surface of the toner, which is roughened by external additive particles, is smoothed, resulting in increase of the adhesiveness of the toner to the photoreceptor, i.e., deterioration of cleanability of the toner. Therefore, under low humidity conditions, a cleaning problem in that the toner particles on the photoreceptor cannot be easily removed therefrom occurs. In this case, the toner particles on the photoreceptor are transferred to a receiving material, resulting in occurrence of a background fouling problem in that the background area of an image is soiled with toner particles.

When the toner receives a pressure, external additive particles present on toner particles tend to be embedded into the toner particles because a material harder than the toner particles is generally used as the external additive (external additives are explained below). When the amount of external additive particles present on the surface of toner particles decreases, the chargeability of the toner changes. Particularly, when a silica, which has a large specific surface area, is used as an external additive and in addition the external additive is embedded in to toner particles, the chargeability of the toner particles largely changes.

Further, when external additive particles present on toner particles are embedded into the toner particles, the fluidity of the toner particles deteriorates, thereby increasing the adhesiveness of the toner particles to members such as image bearing members and developer bearing members. When the adhesiveness between toner particles and an image bearing member increases, the background fouling problem occurs. In addition, when the adhesiveness between toner particles and a developer bearing member increases, the developing property of the toner deteriorates. Thus, when a developing device is used for developing electrostatic images for a long period of time, the content of such deteriorated toner particles in a developing unit and a hopper increases and the amount of the toner particles therein decreases.

In general, when a fresh one-component non-magnetic developer is supplied from a toner cartridge, at first toner particles having a relatively small particle diameter are selectively transported to the developing sleeve. Therefore, after long use of the developer, toner particles having a relatively large particle diameter tend to remain in the developing device while the external additive on the toner particles is embedded thereinto, resulting in deterioration of image qualities and occurrence of a toner scattering problem in that toner particles scatter around the developing device.

In the developing device 30 of the present invention, toner particles remaining in the developing unit 31 are returned to the toner cartridge 32 through the opening 33 to be mixed with fresh toner particles in the toner cartridge 32, resulting in decrease of the content of deteriorated toner particles in the developer. The thus mixed toner particles are supplied to the developing unit 31 through the opening 33 to be used for developing electrostatic images.

Figure 3A:
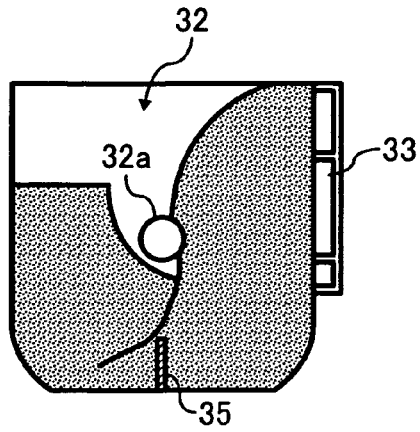
FIGS. 3A-3C are schematic views for explaining how the toner in the cartridge is agitated and transported by a rotating member in the developing device illustrated in FIG. 1.
Figure 3B:
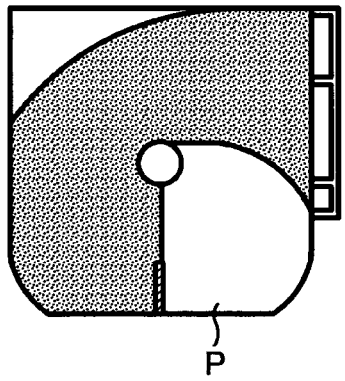
Figure 3C:
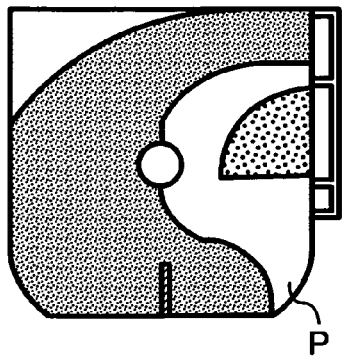

FIGS. 3A-3C are schematic views for explaining how the toner particles in the toner cartridge 32 are moved by the second paddle 32*a*.

Referring to FIGS. 1 and 3A-3C, in the toner cartridge 32, the third paddle 32*b* in the second toner storage room 322 transports toner particles to the first toner storage room 321. The second paddle 32*a* transports the thus transported toner particles toward the developing unit 31. The second paddle 32 includes one bendable film (i.e., a bendable blade). By rotating the film, the toner particles in the first toner storage room 321 are fed toward the developing unit 31. In addition, the rib 35 is provided on the bottom surface of the first toner storage room 321. When the film of the second paddle 32*a* is located at such a position as to be contacted with the rib 35 as illustrated in FIG. 3B, the toner particles are blocked by the film which is stopped while bent at the rib for a while and thereby the blocked toner particles are hardened. When the bent film is released from the rib, the film throws up the toner particles present before the film. On the other hand, the hardened toner particles remain before the rib for a while. Thus, a space P is formed. The degree to which the wall of the hardened toner particles easily collapses can be represented by the powder wall collapsing angle of the toner. After a space is formed for a while on the downstream side from the film relative to the rotation direction of the film, the space P is gradually filled with toner particles having good fluidity.

The second paddle 32*a* is further rotated, part of the toner particles present on the upstream side is pressed into the developing unit 31 by the film through the openings 33. Thus, the toner particles in the toner cartridge 32 are supplied to the developing unit 31. When the second paddle 32*a* is further rotated and the space is formed near the openings 33 as illustrated in FIG. 3C, part of the toner particles in the hopper 311 is transported (returned) to the cartridge by the first paddle 31*d* through the openings 33. Thus, return of the toner particles to the toner cartridge 32 from the developing unit 31 is accelerated due to the space P formed by the film of the second paddle 32*a* and the rib 35.

The volume of the space P gradually decreases due to invasion of toner particles having a relatively large fluidity. In order that the space P has a sufficient volume for a predetermined time and thereby the toner particles in the developing unit 31 are smoothly returned to the toner cartridge 32, the toner preferably has a fluidity in a certain range. In this case, the toner particles preferably have a powder wall collapsing angle, which is the substitution property of the fluidity of the toner, of from 30 to 70°.

In the present application, the powder wall collapsing angle of a toner (developer) is determined by the following method.

Figure 4:
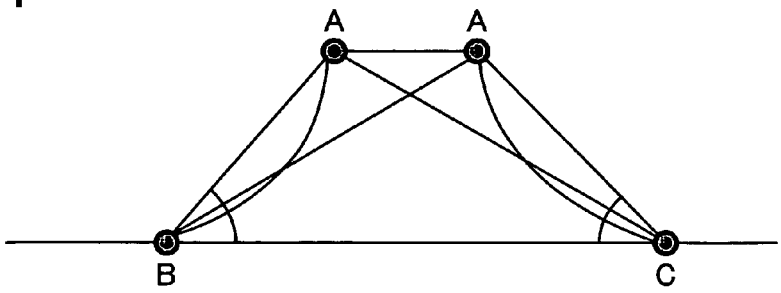
FIG. 4 is a schematic view for explaining the way to measure the powder wall collapsing angle of a toner.

(1) Ten (10) grams of a toner is contained in a cylindrical glass container having a diameter of 3 cm and a length of 7 cm and then the container is capped;

(2) The container is shaken for 1 minute with a shaker (MODEL YS-8D from Yayoi Co., Ltd.) under conditions of 80 mm in stroke and 100 times per minute in shaking speed to impart a fluidity to the toner;

(3) The thus shaken toner is fed into a glass cylinder which has no upper and lower bottoms and has a diameter of 3 cm and a length of 5 cm and which is vertically set on a repose angle measuring attachment of a powder tester (PT-N from Hosokawa Micron Corp.);

(3) After being allowed to settle for 1 minute, the cylinder is raised vertically at a speed of 3 cm/sec to form a mountain of the toner on the repose angle measuring part as illustrated in FIG. 4;

(4) The angle ∠ABC or ∠ACB (which is defined as the powder wall collapsing angle) is measured using an arm of the repose angle measuring attachment.

As mentioned above, by using a toner having a fluidity in the above-mentioned proper range, the space P has a sufficient volume and in addition the space P can be maintained for a while. Therefore, movement of the toner particles from the hopper 311 to the toner cartridge 32 can be smoothly performed. When the powder wall collapsing angle is too low, the toner has too large fluidity and thereby a space P having a sufficient volume cannot be formed. In contrast, when the angle is too high, the toner has poor fluidity (i.e., the toner has poor developability).

The toner for use in the developing device of the present invention preferably has an aggregation rate of from 6 to 15%. The aggregation rate of a powder is an index indicating how the powder is easily aggregated, and a toner having a smaller aggregation rate does not aggregate easily. In general, the aggregation rate relates to the fluidity, and the smaller aggregation rate a toner has, the better fluidity the toner has. When the aggregation rate of the toner used for the developing device is too small, the toner has too large fluidity and therefore a space P having a sufficient volume cannot be formed. In contrast, when the aggregation rate is too large, the toner has poor fluidity (i.e., the toner has poor developability).

In the present application, the aggregation rate of a toner is determined by the following method.

(1) A combination of a sieve with 400-mesh, a sieve with 200-mesh and a sieve with 100-mesh is set on a vibrating table of a powder tester from Hosokawa Micron Corporation so that the sieve with 400-mesh has an uppermost position;

(2) Two grams of a toner is set on the uppermost sieve and the sieves are vibrated for 10 seconds; and (3) The weight of the toner particles remaining on each of the sieves is measured.

The aggregation rate of the toner is determined by the following equation (1):

$$\text{Aggregation rate}(\%)=(W_{100}/2)\times 100+(W_{200}/2)\times 100\times 0.6+(W_{400}/2)\times 100\times 0.2 \quad (1)$$

wherein $W_{100}$, $W_{200}$ and $W_{400}$ represent the weights in units of gram of the toner particles on the sieve with 100-mesh, sieve with 200-mesh and sieve with 400-mesh, respectively.

The toner for use in the developing device of the present invention preferably has a bulk density of from 0.38 to 0.43 g/cm$^3$. In this case, the toner has proper fluidity. The bulk density of a powder is defined as the density of the powder which falls on a container while being sieved. In the present application, the bulk density is measured using a powder tester (PT-N from Hosokawa Micron Corp.). The method for determining the bulk density is as follows.

(1) A sieve having openings with a diameter of 246 μm is set on a vibration table;

(2) Then 250 cc of a toner is fed into the sieve and the sieve is vibrated for 30 seconds to feed the toner in a container with a volume of 100 cc;

(3) A blade is slid along the upper surface of the container to remove excessive toner particles projected from the container;

(4) The weight (W g) of the toner in the container is measured to determine the bulk density of the toner (W g/100 cc); and (5) The operations (1)-(4) are repeated five times to determine the average bulk density of the toner.

The powder tester mentioned above automatically perform the operations (1)-(5).

The developing device is further explained in detail.

Referring to FIG. 1, the developing device 30 includes the developing unit 31 which includes the developing sleeve 31*a* configured to bear the toner thereon to develop electrostatic images on an image bearing member (such as photoreceptors), the first paddle 31*d* which rotates to scoop and agitate the toner, and the hopper 311 configured to temporarily store the toner supplied from the toner cartridge; and the toner cartridge 32. The developing unit 31 can be separated from the toner cartridge 32 because the developing unit has durability several times that of the cartridge (i.e., the toner cartridges can be replaced several times while one developing unit is used).

The internal temperature ($T_H$) of the hopper 311 is preferably 35±5° C., and the internal temperature ($T_C$) of the cartridge is 30±5° C., wherein $T_H > T_C$.

Figure 11:
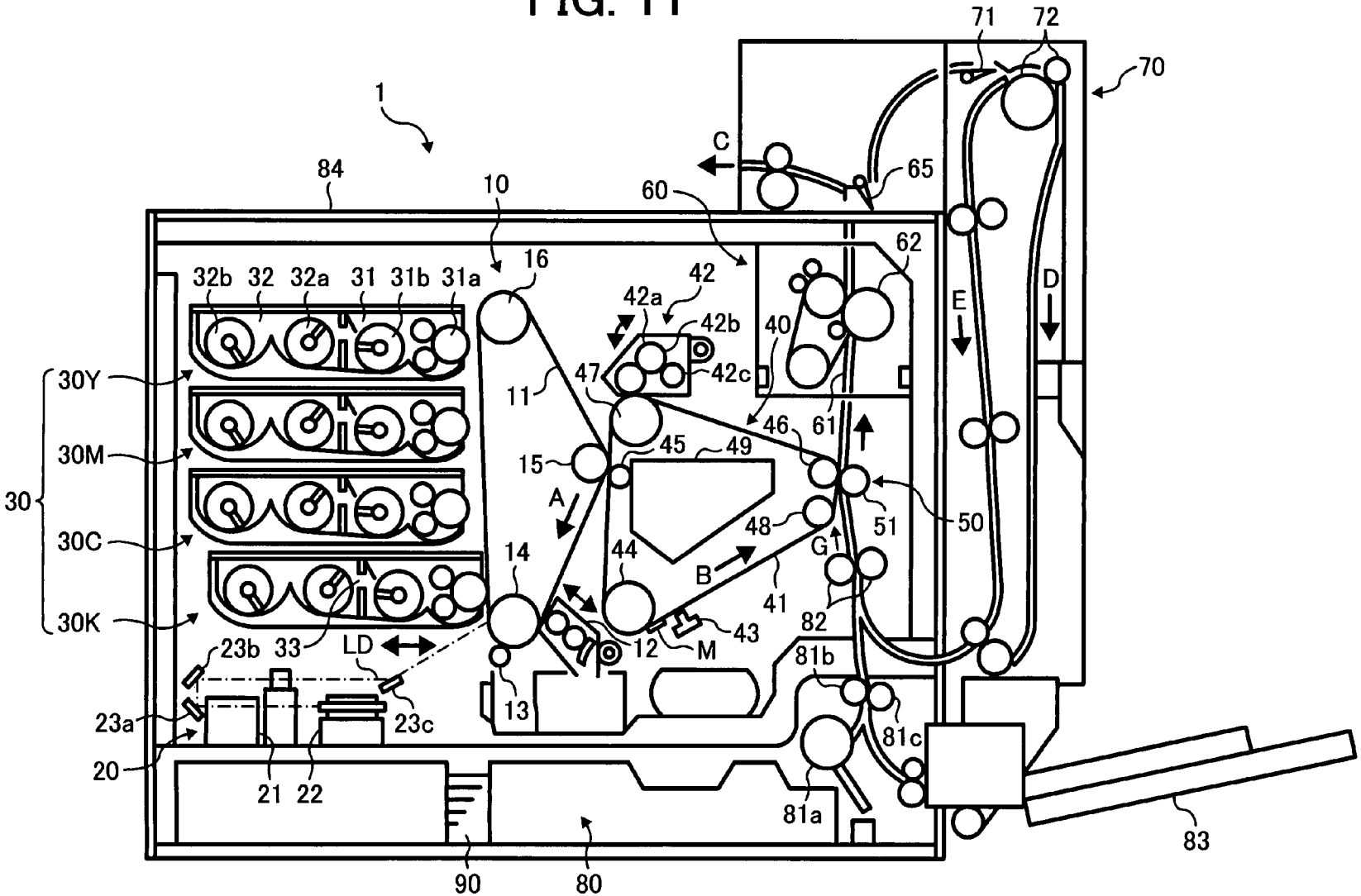
FIG. 11 is a schematic view illustrating an example of the image forming apparatus of the present invention.

The first paddle 31*d* of the developing unit 31 feeds the toner to the developer supply roller 31*b* while agitating the toner. The toner supply roller 31*b* rubs the developing sleeve 31*a* and the toner to frictionally charge the toner. The thus charged toner is borne on the surface of the developing sleeve 31*a* by an image force. The toner layer thickness control roller 31*c* controls the thickness of the toner layer transported to the developing region. As illustrated in FIG. 11, electrostatic images are developed at the developing region with the toner layer formed on the developing sleeve 31*a* while a developing bias is applied between a photoreceptor belt 11 and the developing sleeve 31*a*.

As mentioned above, the toner rubbed by the toner supply roller 31*b* at the developing sleeve 31*a* receives a large pressure, and thereby the roughened surface of the toner particles are cut or the external additive particles thereon are embedded into the toner particles. Therefore, the surface of the toner particles are smoothed, resulting in increase of the adhesiveness of the toner particles and decrease of the fluidity of the toner particles. In this case, the charging ability of the toner particles deteriorates because the external additive is embedded into the toner particles. As a result, the developability, transferability and cleanability of the toner deteriorate.

Thus, the amount of such deteriorated toner particles increases in the hopper 311, and in addition the amount of the toner particles contained in the developing unit 31 decreases. In this case, the toner in the toner cartridge 32 is replenished to the developing unit 31. The toner cartridge 32 has the second paddle 32*a* which rotates while the tip thereof is contacted with the inner surface of the first toner storage room 321 and the third paddle 32*b* which rotates while the tip thereof is contacted with the inner surface of the second toner storage room 322. When the second and third paddles 32*a* and 32*b* are rotated, the toner in the toner cartridge 32 is transported to the developing unit 31 through the openings 33.

In addition, the toner particles in the developing unit 31 is returned to the cartridge 32 through the openings 33, and thereby the toner in the developing unit 31 is mixed with the toner in the cartridge 32. Since a large amount of unused toner particles are present in the toner cartridge 32, the external additive particles on such unused toner particles are re-distributed on the deteriorated toner particles. In addition, the deteriorated toner particles which have a relatively large particle diameter are mixed with unused toner particles having a relatively small particle diameter, and thereby the average particle diameter of the toner is decreased. Therefore, the charging property and fluidity of the deteriorated toner particles are changed so as to be similar to those of the unused toner particles.

Thus, the toner particles in the developing unit 31 are discharged to the fist toner storage room 321 and the toner particles are further transported to the second toner storage room 322 with the second paddle 32*a*. The toner particles are then transported to the first toner storage room 321 with the third paddle 32*b*. During this toner transportation, the external additive particles on the unused toner particles are re-transferred to the surface of the deteriorated toner particles, resulting in revival of the deteriorated toner particles.

The mixture of the thus revived toner particles and unused toner particles are supplied again to the developing unit 31 from the first toner storage room 321. The toner particles thus transported to the developing unit 31 are used for developing electrostatic images. Therefore, high quality images can be produced for a long period of time.

Figure 5:
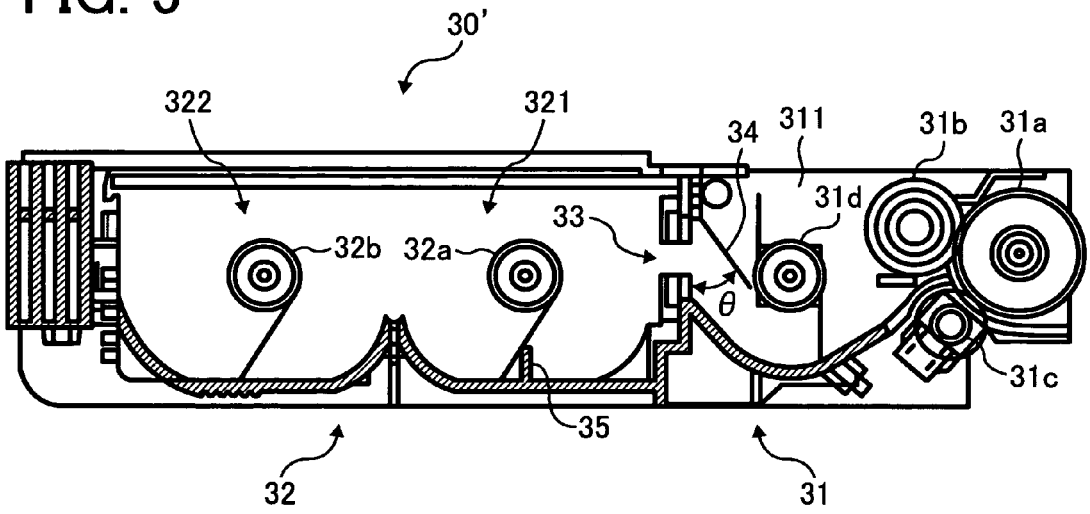
FIG. 5 is a schematic view illustrating another example of the developing device of the present invention.
Figure 6:
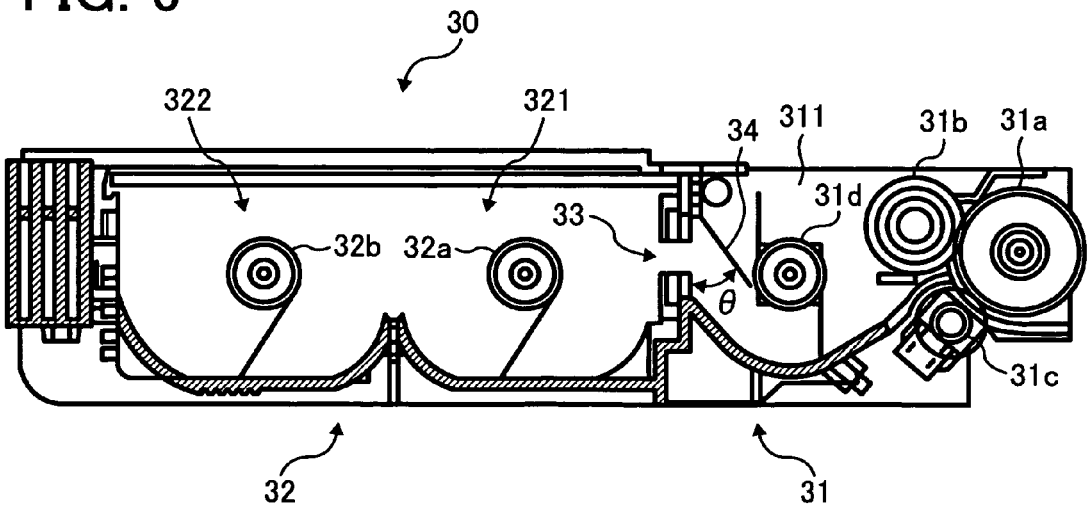
FIG. 6 is a schematic view illustrating yet another example of the developing device of the present invention.
Figure 7:
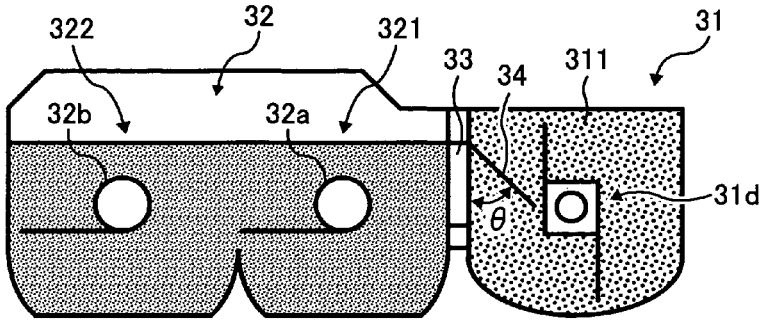
FIG. 7 is a simplified view of the cartridge and the hopper of the developing device illustrated in FIG. 6.

As illustrated in FIG. 5, a developing device 30' of the present invention can include a control valve 34. The control valve is located in the vicinity of the opening 33 and accelerates supply of the toner from the toner cartridge 32 to the developing unit 31 by being moved right and left by the film of the first paddle 31*d*. In addition, the control valve controls return of the toner from the developing unit 31 to the toner cartridge 32 by shutting or opening the opening 33 by being moved right and left by the film of the first paddle 31*d*.

Figure 8:
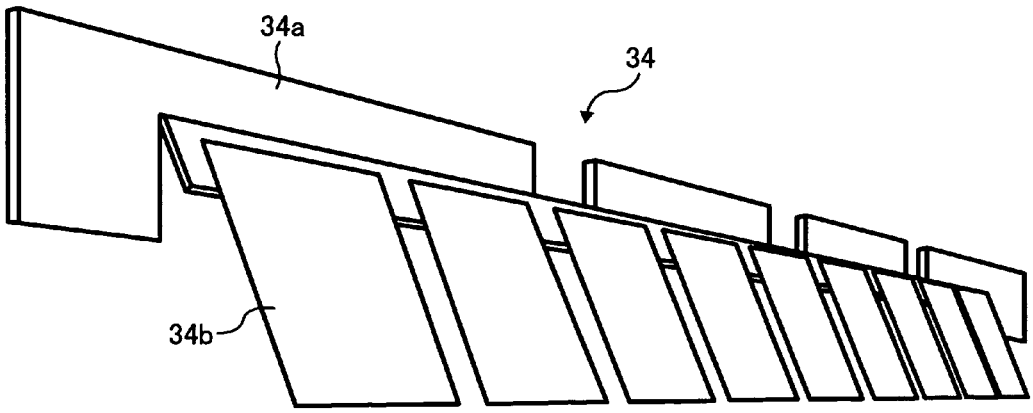
FIG. 8 is a schematic view illustrating a valve for use in the hopper of the developing device illustrated in FIG. 5.

FIG. 8 is a schematic view illustrating an example of the control valve for use in the developing device of the present invention. The control valve 34 is provided so as to face the openings 33 and includes a support 34*a* and films 34*b* which are adhered to the support 34*a*. The support 34*a* is fixed to the main body of the developing device 30'. The films 34*b* have a rectangular form and are arranged side by side at regular intervals so as to face the respective openings 33. The support 34*a* is made of a rigid metal such as SUS, Cu and Al, and the films 34*b* are made of an elastic resin such as polypropylene, polyethylene, polyester and fluorine-containing resins.

The first paddle 31*d* in the developing unit 31 has one or more films and the films rotate to transport the toner, which is supplied from the toner cartridge 32, to the developing sleeve 31*a*. The films may have a plate form. The form of the film(s) of the first paddle is not particularly limited. For example, the film may be a single film (or a plate) having rectangular form, a single film (or plate) in which the portions facing the films 34*b* have a rectangular form, films facing the films of the film 34*b* or combination thereof or the like.

FIGS. 9A-9D are schematic views for explaining how the toner in the toner cartridge is transported to the developing unit 31.

Figure 9A:
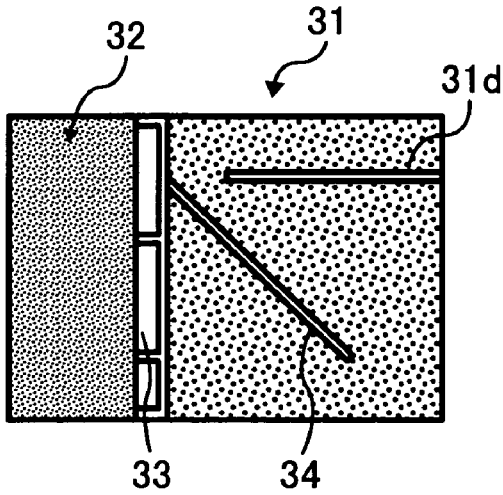
FIGS. 9A-9D are schematic views illustrating how the toner in the cartridge is supplied to the hopper by the valve in the hopper.
Figure 9B:
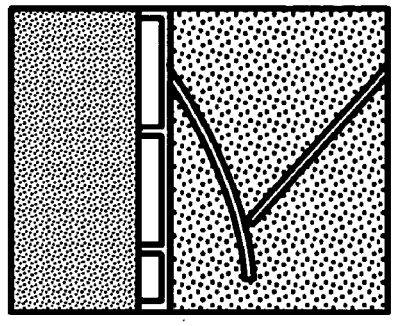
Figure 9C:
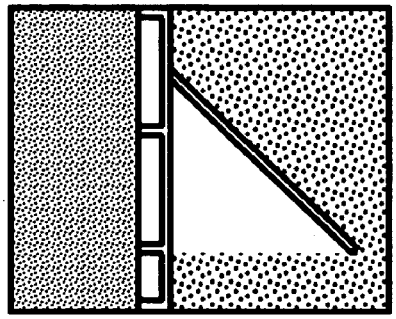

As illustrated in FIGS. 9A-9B, when the rotating film of the first paddle 31*d* hits the control valve 34, the control valve 34 is bent by the pressure of the first paddle. When control valve 34 is released from the film of the first paddle 31*d*, the control valve 34, which has an elasticity, rapidly returns to the home position. In this case, the toner in the toner cartridge, which is pressed by the second paddle 32*a* toward the openings 33, enters into the developing unit 31. Thus, the toner is supplied to the developing unit 31 from the toner cartridge 32.

Figure 9D:
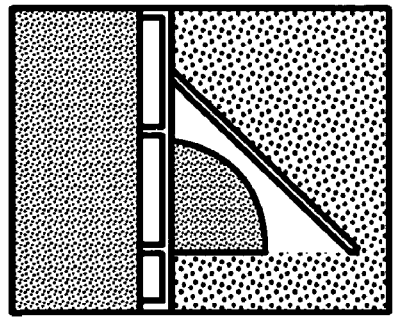

In the developing device 30', the paddle 32*a* carries out operations similar to those illustrated in FIGS. 3A-3C. Specifically, when the toner in the first containing room is pressed by the second paddle 32*a* as illustrated in FIG. 3B and in addition the control valve 34 has the home position (illustrated in FIG. 9C), the toner is transported from the toner cartridge 32 to the developing unit 31 as illustrated in FIG. 9D. In this regard, the toner preferably has a powder wall collapsing angle of from 5 to 50° so as to be smoothly supplied to the developing unit 31. The thus supplied toner is mixed with the toner in the developing unit 31 and the toner in the developing unit 31 achieves such a state as illustrated in FIG. 9A. When the toner particles near the openings 33 are pressed by the control valve 34 as illustrated in FIG. 9B and in addition the space P is formed in the toner cartridge 32 as illustrated in FIG. 3C, the pressed toner particles are discharged to the toner cartridge 32 as illustrated in FIG. 3C.

The movement of the first, second and third paddles 31*d*, 32*a* and 32*b* and the toner in the developing device 30' will be explained in detail referring to FIGS. 10A-10P.

Figure 10A:
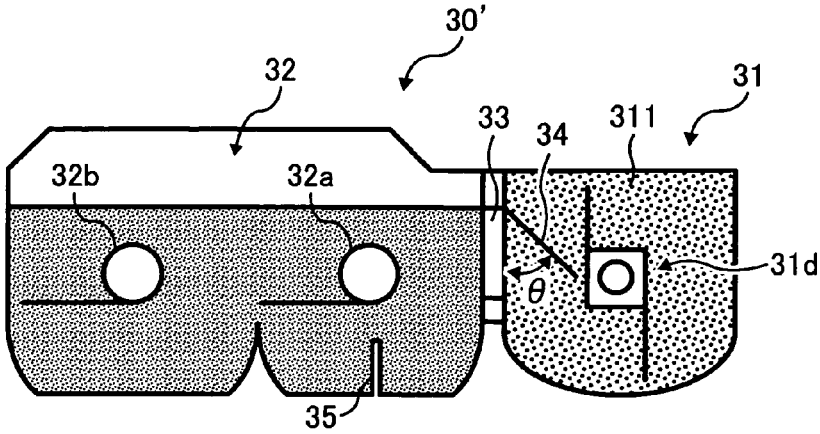
FIGS. 10A-10P are schematic views for explaining how the toner in the cartridge and the hopper is mixed.
Figure 10B:
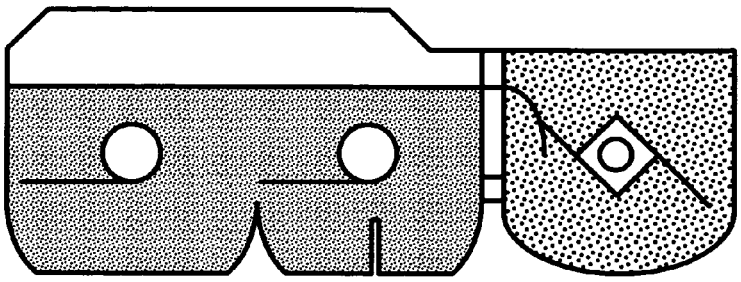
Figure 10C:
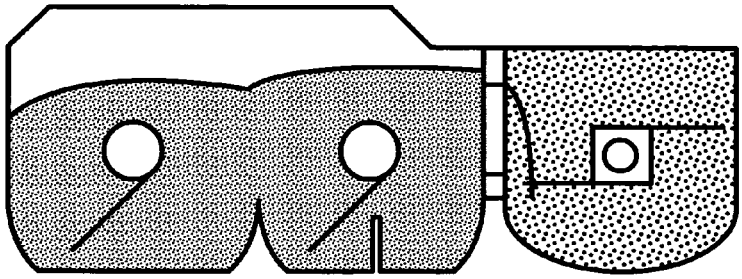
Figure 10D:
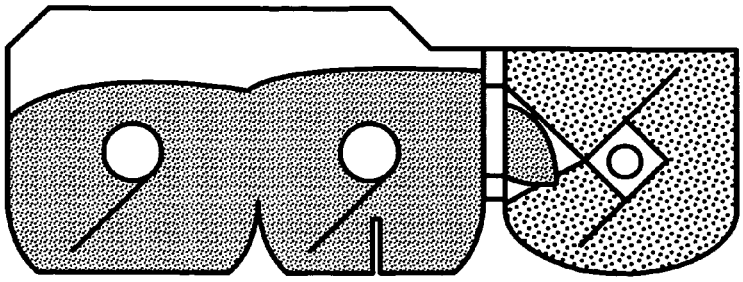
Figure 10E:
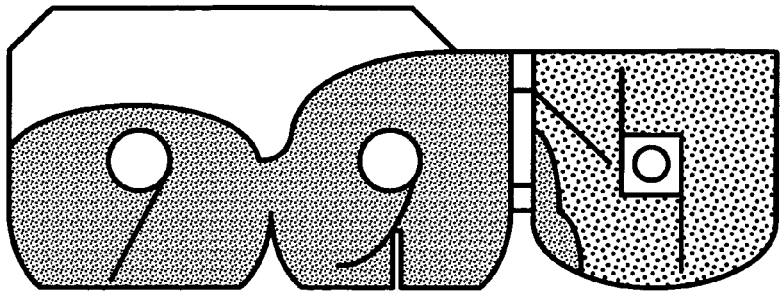
Figure 10F:
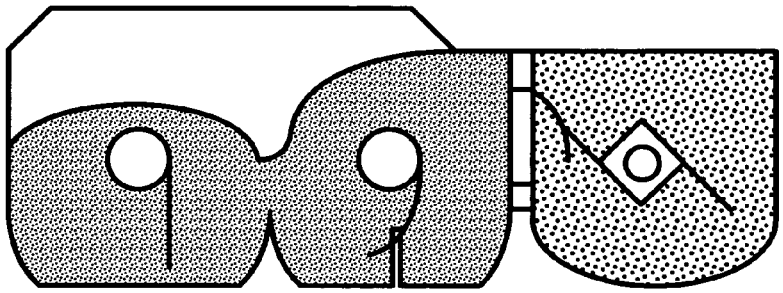
Figure 10G:
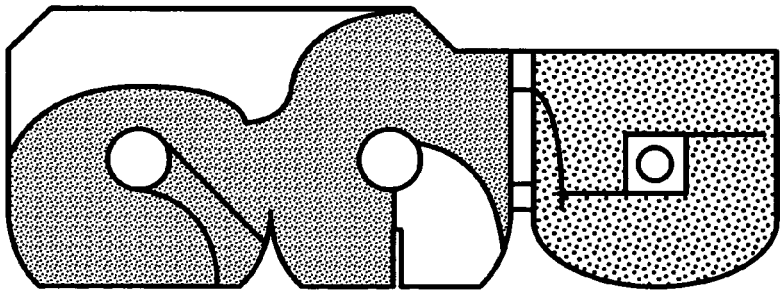
Figure 10H:
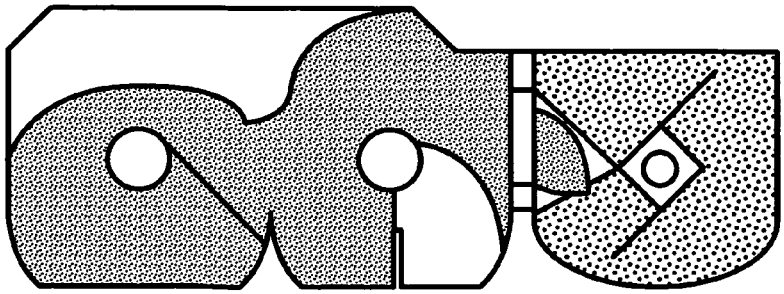
Figure 10I:
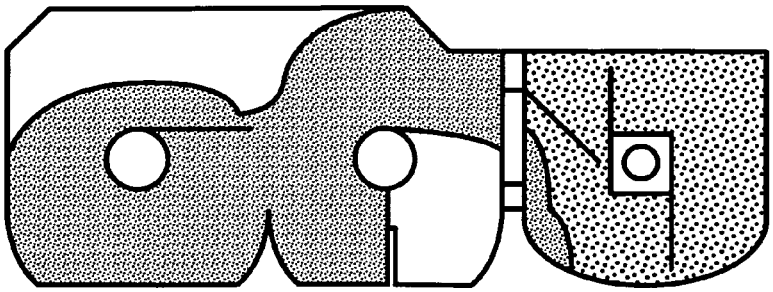
Figure 10J:
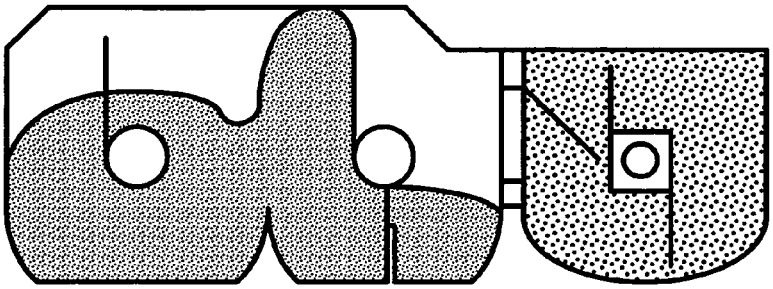
Figure 10K:
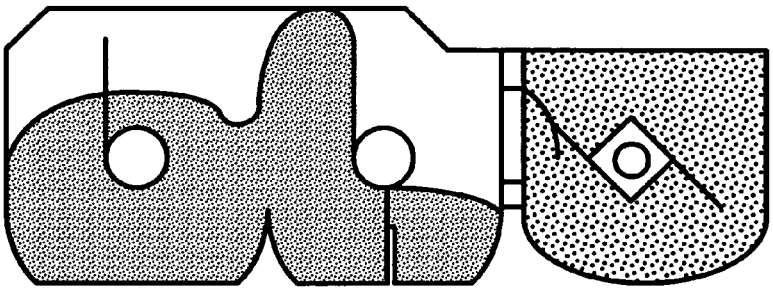
Figure 10L:
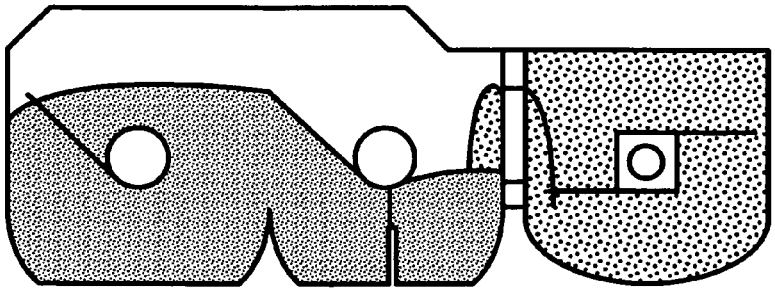
Figure 10M:
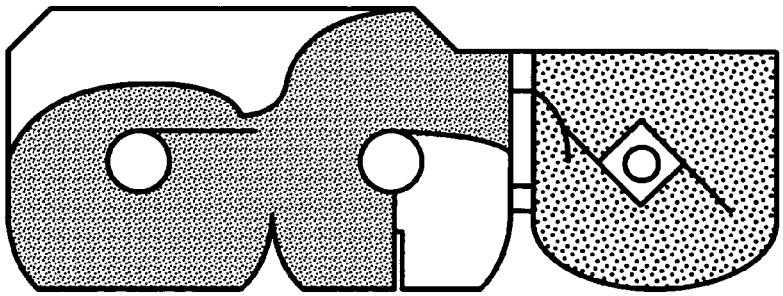
Figure 10N:
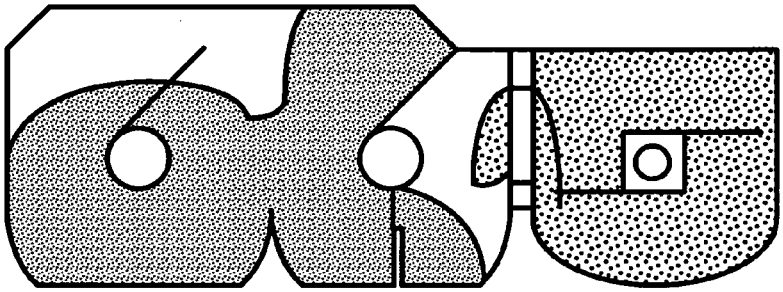
Figure 10O:
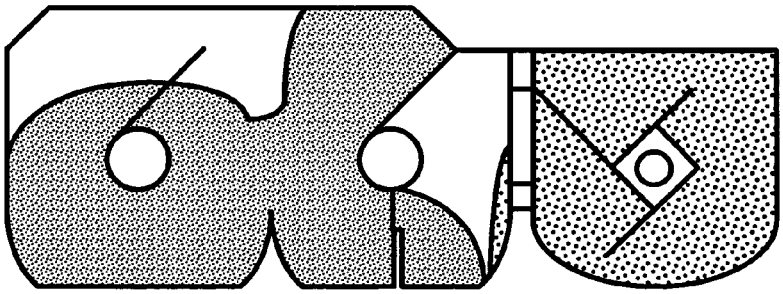
Figure 10P:
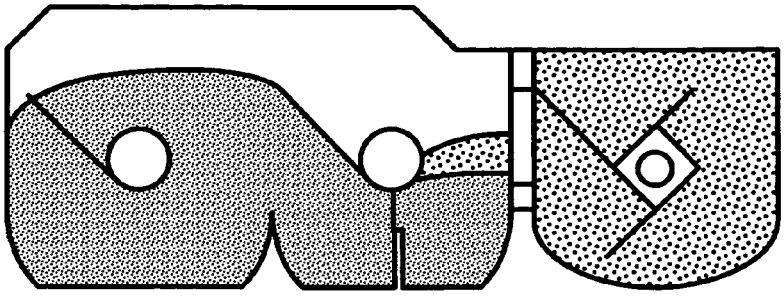

FIGS. 10A-10P are schematic views for explaining how the toner is moved between the developing unit 31 and the toner cartridge 32. FIGS. 10A-10P mainly illustrate the toner cartridge 32 and the hopper 311, and the developing sleeve 31*a*, the supply roller 31*b*, the toner thickness controlling roller 31*c*, etc. are omitted.

As illustrated in FIG. 10A, the control valve 34 is set so as to form an angle of θ against the wall, in which the openings 33 are provided, at the home position thereof. In this developing device 30', the first paddle 31*d* rotates plural films, and each of the second and third paddles rotates a single film.

As illustrated in FIG. 10B, in the developing unit 31 the plural films of the first paddle 31*d* press the control valve 34, thereby pressing the toner particles present between the control valve 34 and the openings 33. Since the first toner storage room 321 is filled with the toner (i.e., there is no space in the vicinity of the opening 33 in the first toner storage room 321), the toner particles cannot be discharged to the first toner storage room 321 and are moved downward or laterally in the developing unit 31.

Then the control valve 34 is further pressed by the films of the first paddle 31*d* so as to be close to the openings 33 as illustrated in FIG. 10C. Further, when the control valve 34 is released from the films of the first paddle 31*d*, the control valve 34 returns to the home position, resulting in formation of a space between the control valve 34 and the openings 33 as illustrated in FIG. 10D, and thereby the toner in the first toner storage room 321 is supplied to the developing unit 31 as illustrated in FIGS. 10D and 10E.

Then the films of the first paddle 31*d* press again the control valve 34 as illustrated in FIG. 10F. On the other hand, the film of the second paddle 32*a* is contacted with the rib 35 in the first toner storage room 321. The films of the first paddle 31*d* further press the control valve 34 so that the control valve is close to the openings. In this case, the film of the second paddle 32*a* is further rotated so as to be released from the rib 35, and thereby a space is formed on a lower right portion of the first toner storage room as illustrated in FIG. 10G.

Then the films of the first paddle 31*d* are released from the control valve 34 and thereby the control valve 34 returns to the home position, a space is formed between the control valve 34 and the openings 33 as illustrated in FIG. 10H. Therefore, the toner particles pressed by the film of the second paddle 32*a* in the first toner storage room is supplied to the developing unit 31 through the openings 33 as illustrated in FIGS. 10H and 10I.

Further, another film of the first paddle 31*d* presses the control valve 34 as illustrated in FIGS. 10J-10L. In this case, since a space is formed in the vicinity of the openings 33 in the first toner storage room 321, the toner particles between the control valve 34 and the openings 33 are discharged to the toner cartridge 32 from the developing unit 31.

In this regard, when the toner has too large fluidity, the space formed in the first toner storage room 321 rapidly disappears because the toner particles in the vicinity of the space rapidly enter into the space. Therefore, the toner preferably has a powder wall collapsing angle of from 30 to 70°.

In addition, as illustrated in FIGS. 10M-10P, by rotating the first paddle 31*d* at a speed higher than that of the second paddle 32*a*, the toner in the developing unit 31 can be well discharged to the toner cartridge 32. By repeating these operations, the toner can be moved between the developing unit 31 and the toner cartridge 32.

Thus, by changing the rotation speeds of the first paddle 31*d* and the second paddle 32*a*, the amount of toner particles supplied to the developing unit 31 and the amount of toner particles discharged to the toner cartridge 32 can be adjusted. Particularly, by rotating the first paddle 31*d* at a speed higher than that of the second paddle 32*a* (i.e., the time during which a space is formed in a portion of the first toner storage room 321 in the vicinity of the openings 33 is prolonged while the number of toner pressing operations of the first paddle 31*d* is increased), the number of toner discharging operations to the toner cartridge 32 from the developing unit 31 can be increased.

In addition, the amount of supplied or discharged toner particles can be adjusted by changing the number of the openings 33. The number of the openings is not less than 1, and is preferably determined depending on the image forming speed of the image forming apparatus for which the developing device is used.

In the developing device of the present invention, the following relationship is satisfied.

$$T_H > T_C$$

wherein $T_H$ represents the internal temperature of the hopper 311, and $T_C$ represents the internal temperature of the toner cartridge 32. In addition, the toner satisfies the following relationship:

$$0.9 < CQDP_{45^\circ C.}/CQDP_{25^\circ C.} < 1.5$$

wherein $CQDP_{45^\circ C.}$ and $CQDP_{25^\circ C.}$ represent a charge quantity distribution parameter of the toner under conditions of 45° C. and 54% RH and 25° C. and 54% RH, respectively, and wherein the charge quantity distribution parameter CQDP is determined by the following equation:

$$CQDP = \Sigma[(q/d) \times C]/Wh$$

wherein q represents the charge quantity of a toner particle, d represents the diameter of the toner particle, C represents the number of toner particles having such a charge quantity and a particle diameter, and Wh represents the half width of the charge quantity distribution curve of the toner.

In general, the internal temperature and humidity of the hopper are different from those of the toner cartridge. Therefore, since the toner in the developing device of the present invention is repeatedly supplied to the developing device and discharged to the toner cartridge, the toner is repeatedly allowed to be present in two different environments. However, the toner has the controlled charge distribution property mentioned above even when the environmental temperature is changed, and therefore high quality images can be stably produced.

The charge quantity distribution parameter is defined as a value obtained by dividing the integration of the charge distribution peak (i.e., $\Sigma[(q/d) \times C]$) by the half width (Wh) of the peak. A weakly charged toner has a small integration value (i.e., $\Sigma[(q/d) \times C]$), and therefore the toner has a small charge quantity distribution parameter. A strongly charged toner having a broad charge quantity distribution peak has a large half width, and therefore the toner has a small charge quantity distribution parameter. Only a strongly charged toner having a sharp charge quantity distribution peak has a large charge quantity distribution parameter.

The charge quantity distribution of a toner can be determined by the following method.

A toner is mixed with a ferrite carrier which has an average particle diameter of 50 μm and whose surface is coated with a silicone resin layer having an average thickness of 0.3 μm such that the toner concentration is from 3 to 7% by weight. Then 2 g of the developer is contained in a stainless steel cylinder having a diameter of 2.5 cm and a height of 3.0 cm. The cylinder is set on a ball mill stand to be rotated for 30 seconds at a speed of 250 rpm. The charge quantity distribution of the toner is measured with an instrument E-SPART ANALYZER EST-II from Hosokawa Micron Corp., and a two-component feeder. Thus, a charge quantity distribution curve in which q/d (in units of femto-C/10 μm) is plotted on the X-axis and number of particles (in units of pieces) are plotted on the Y-axis) can be obtained. From this charge quantity distribution curve, the charge quantity distribution parameter of the toner can be determined.

Next, the ratio, $CQDP_{45° C.}/CQDP_{25° C.}$ (i.e., environmental changing rate of the charge quantity distribution parameter), will be explained in detail.

Two (2) grams of a developer including a toner and the carrier mentioned above at a toner concentration of from 3 to 7% by weight is contained in the stainless steel cylinder mentioned above. The cylinder is allowed to settle for 2 hours in a chamber (HUMIDITY CABNET LHL-113 from ESPEC CORP.) in which the temperature and relative humidity are controlled to be 45° C. and 54% RH. Then the cylinder is set on a ball mill stand to be rotated for 30 seconds at a rotation speed of 250 rpm. Then the charge quantity distribution of the thus agitated developer is measured with an instrument E-SPART ANALYZER EST-II from Hosokawa Micron Corp., to determine the charge quantity distribution parameter at 45° C. and 54% RH (i.e., $CQDP_{45° C.}$). Similarly, the procedure for measurements of the $CQDP_{45° C.}$ is repeated except that the environmental condition is changed to 25° C. and 54% RH. Thus, the ratio $CQDP_{45° C.}/CQDP_{25° C.}$ (hereinafter referred to as an environmental changing rate) can be determined.

When the environmental changing rate is too small, the toner has a low charge quantity and/or a broad charge quantity distribution curve under high temperature conditions, resulting in deterioration of image qualities (for example, occurrence of background fouling). In contrast, when the environmental changing rate is too large, the toner has a high charge quantity and/or a sharp charge quantity distribution curve under high temperature conditions, and thereby it becomes difficult to form a thin toner layer on a developer bearing member, resulting in deterioration of image qualities (for example, decrease of image density).

The toner for use in the developing device of the present invention preferably has a charge quantity (i.e., $\Sigma[(q/d)\times C]$) of from 7000 to 12000 in absolute value. In addition, the toner preferably has a charge quantity distribution parameter (i.e., $\Sigma[(q/d)\times C])/Wh$) of from 2000 to 5000 at 45° C. and 54% RH and 25° C. and 54% RH. In addition, the half width (Wh) of the peak is preferably from 1.0 to 3.5.

(2066-[0034])

In the developing device of the present invention, supply of the toner from the toner cartridge 32 to the developing unit 31 and discharge of the toner to the toner cartridge from the developing unit 31 are controlled by the control valve 34, and thereby the amount of toner in the hopper 311 can be controlled. It is preferable that the volume ratio of space in the hopper (hereinafter referred to as a space ratio) is from 20 to 70% and more preferably from 30 to 50%. When the space ratio is from 30 to 50%, the volume occupied by the developer is from 70 to 50%. The space ratio is determined as follows. When the hopper is filled with a developer, the space ratio is defined as 0%. Let's assume that the weight of the developer is W1 g in this case. If W2 g of the developer is contained in the hopper, the space ratio is $(1-W2/W1)\times 100$ (%).

When the space ratio of the hopper is too small, the toner in the hopper cannot be well agitated, and thereby the amount of deteriorated toner particles is increased, resulting in deterioration of image qualities (for example, occurrence of the background fouling problem). In contrast, when the space ratio is too large, a problem in that when images including a large solid image are continuously produced, the images have a low image density tend to be formed because a sufficient amount of developer cannot be supplied to the developing sleeve. In addition, since the time in which the developer is contacted with air increases in this case, image qualities deteriorate (for example, background fouling occurs) under high temperature and high humidity conditions.

Even when the space ratio is relatively large compared to the conventional developing devices as mentioned above, the developer for use in the developer of the present invention can withstand environmental conditions because the developer has the above-mentioned charge quantity distribution parameter changing rate. Therefore, high quality images without background fouling can be produced.

By using the developer mentioned above, the background density of a toner image formed on the image bearing member of the image forming apparatus of the present invention (mentioned below) can be controlled to be less than 0.01.

The background density is measured as follows.

After a running test in which 20,000 (or 50,000 or 80,000) copies of an image with an image area proportion of 5% are produced, a white solid image is formed. In the middle of the developing operation, the power of the image forming apparatus is suddenly turned off. An adhesive tape is adhered to a developed portion of the photoreceptor to transfer the toner particles on the photoreceptor to the adhesive tape. The densities of randomly selected three points of each of the adhesive tape with the toner particles and the blank adhesive tape are measured with a spectrodensitometer (X-Rite 938 from X-Rite Inc.) to determine the difference between the average densities of the adhesive tape with the toner particles and the blank adhesive tape (i.e., the background density).

Next, the image forming apparatus of the present invention will be explained referring to drawings.

FIG. 11 is a schematic view illustrating an example of the image forming apparatus of the present invention. In FIG. 11, an image forming apparatus 1 includes a photoreceptor unit 10, an image writing device 20, a developing device 30 (i.e., a black (K) developing device 30K, a cyan (C) developing device 30C, a magenta (M) developing device 30M or a yellow developing device 30Y), an intermediate transfer device 40, a secondary transfer device 50, a fixing device 60, a paper reversing device 70 configured to reverse a receiving material to produce double-sided copies, etc. An electrostatic image formed on a photoreceptor belt 11 is developed with the black (K) developing device 30K, the cyan (C) developing device 30C, the magenta (M) developing device 30M or the yellow developing device 30Y. The thus prepared color toner images are overlaid on an intermediate transfer medium 41, resulting in formation of a full color image.

Around the photoreceptor belt 11, a photoreceptor cleaning device 12, a charging roller 13, the developing device 30 including the four different color developing devices 30Y, 30M, 30C and 30K, the intermediate transfer medium 41 of the intermediate transfer device 40, etc., are arranged.

The photoreceptor belt 11 is rotated in a direction indicated by an arrow A by a driving roller 14 while tightly stretched by the driving roller 14, a primary transfer counter roller 15, and a tension roller 16. The driving roller 14 is rotated by a driving motor (not shown).

The image writing device 20 is configured to convert color image information to light signals and to write optical image information including the light signals to form electrostatic images corresponding to respective color images on the photoreceptor belt 11. The image writing device 20 includes a laser diode 21 configured to emit a laser light beam, a polygon mirror 22, and three reflection mirrors 23*a*, 23*b* and 23*c*.

In the developing device 30, the black (K) developing device 30K containing a black toner (i.e., a black developer) to form a black color toner image, the cyan (C) developing device 30C containing a cyan toner to form a cyan color toner image, a magenta (M) developing device 30M containing a magenta toner to form a magenta color toner image or a yellow developing device 30Y containing a yellow toner to form a yellow color toner image are vertically arranged in this order. Each of the developing devices 30K, 30C, 30M and 30Y can be laterally moved so as to attached to or detached from the photoreceptor belt 11 using an attach/detach mechanism (not shown).

The toner in the developing device 30 is charged to have a predetermined polarity. In addition, as mentioned above, the developing device 30 includes a developing sleeve 31*a*, to which a developing bias is applied by a power source (not shown). The attach/detach mechanism includes a motor and an electromagnetic clutch. When the electromagnetic clutch is turned on, the driving force of the motor is transmitted to the developing device 30 and thereby the developing device is moved toward the photoreceptor belt 11. Thus, one of the four developing devices is contacted with the photoreceptor belt 11 to develop an electrostatic image on the photoreceptor belt 11. When the electromagnetic clutch is turned off, the developing device is moved so as to be detached from the photoreceptor belt 11.

When the image forming apparatus 1 is in a waiting state, all the four developing devices are detached from the photoreceptor belt 11. For example, when a full color image forming operation is ordered, at first the photoreceptor belt 11 is charged with the charging roller 13, and then the image writing device 20 performs optical black (K) image writing on the charged photoreceptor belt 11. Thus, a (K) electrostatic image corresponding to a black (K) color image is formed on the photoreceptor belt 11. In order that the tip of the (K) electrostatic image can be developed with a black toner (i.e., a black developer), the developing sleeve 31*a* is rotated before the tip of the (K) electrostatic image reaches the developing region. Thus, a black toner image is formed on the photoreceptor belt 11. After the end of the (K) electrostatic image has passed the (K) developing device, the (K) developing device is detached from the photoreceptor belt 11 and the cyan (C) developing device is attached to the photoreceptor belt to develop a (C) electrostatic image. This operation is completed before the tip of the (C) electrostatic image reaches the developing device.

The intermediate transfer device 40 includes the intermediate transfer belt 41, a belt cleaning device 42 configured to clean the surface of the intermediate transfer belt 41, and a position detection sensor 43. The intermediate transfer belt 41 is rotated in a direction indicated by an arrow. B by a driving roller 44 while tightly stretched by the driving roller 44, a primary transfer roller 45, a secondary transfer counter roller 46, a cleaning counter roller 47 and a tension roller 48. Driving the intermediate transfer belt 41 is controlled by the driving motor (not shown). Plural position detection marks M are formed on an edge portion of the intermediate transfer medium 41 in which an image is not formed. When any one of the plural marks is detected with the position detection sensor 43, an image forming operation is started.

The belt cleaning device 42 include a cleaning brush 42*a* and an attach/detach mechanism. When an image (i.e., a black, cyan, magenta or yellow image) is transferred onto the intermediate transfer medium 41, the cleaning brush 42*a* is detached from the intermediate transfer medium 41.

The secondary transfer device 50 includes a secondary transfer roller 51 and an attach/detach mechanism configured to detachably attach the secondary transfer roller 51 to the secondary roller 51. The secondary transfer roller 51 is oscillated such that the rotation axis of the attach/detach mechanism becomes the center of the oscillation, to transfer the toner images on the intermediate transfer medium to a proper position of the receiving material. A receiving material and the intermediate transfer medium 41 are pressure-contacted by the secondary transfer roller 51 and the secondary transfer counter roller 46. The position (parallelism) of the secondary transfer roller 51 relative to the secondary transfer counter roller 46 is secured by a positioning member (not shown) provided on the intermediate transfer device 40. In addition, the contact pressure of the secondary transfer roller 51 against the intermediate transfer belt 41 is controlled to be constant by the positioning roller (not shown). When the color toner images on the intermediate transfer belt 41 are transferred on a receiving material, the secondary transfer roller 51 is contacted with the intermediate transfer belt 41 and a transfer bias with a polarity opposite to that of the toner is applied to the secondary transfer roller 51. Therefore, the color toner images can be well transferred to the receiving material.

On the other hand, when the image forming operation is started, a receiving material is fed from a paper cassette 80 or a manual paper tray 83 and is then stopped at the nip between a pair of registration rollers 82. Then the receiving material is timely fed to the secondary transfer roller 51 so that the color toner images on the intermediate transfer belt 41 are transferred on a proper position of the receiving material. Thus, the combination of the intermediate transfer belt and the receiving material overlaid on the color images on the intermediate transfer belt passes the secondary transfer position (i.e., the nip between the secondary transfer counter roller 46 and the secondary transfer roller 51). In this case, the receiving material is charged by the transfer bias applied to the secondary transfer roller 51, and thereby almost all the color toner images on the intermediate transfer belt 41 are transferred to the receiving material.

The receiving material on which the color toner images are transferred is then fed to the developing device 60, and the toner images are melted and fixed to the receiving material at a nip between a fixing belt 61 heated to a predetermined temperature and a pressure roller 62. The receiving material on which the toner images are fixed is then discharged from the main body of the image forming apparatus 1 and stacked on a tray 84 so that the images face downward. Thus, a full color image can be produced.

When a double sided copy is produced, the receiving material passing the fixing device 60 is fed to a reversal device 70 by a switching pick 65. In the reversal device 70, at first the receiving material is guided in a direction indicated by an arrow D by a reversal pick 71. After the end of the receiving material passes the reversal pick 71, a pair of reversal rollers 72 are stopped to stop the receiving material. After a predetermined period of time, the pair of reversal rollers are reversely rotated to feed the receiving material back. In this case, the reversal pick 71 is switched and thereby the receiving material is fed in a direction indicated by an arrow E by the reversal pick 71 which is switched. Thus, the receiving material is fed to the pair of registration rollers 82 while reversed. The receiving material stopped at the pair of registration rollers 82 is then timely fed to the secondary transfer position by the registration rollers 82. After color toner images on the intermediate transfer belt 41 are transferred on the backside of the receiving material, the color toner images are fixed on the receiving material by the fixing device 60. Then the double sided copy is discharged to the tray 84.

On the other hand, after the primary transfer operation, the surface of the photoreceptor belt 11 is cleaned with the photoreceptor cleaning device 12. In this regard, the photoreceptor belt 11 can be subjected to a discharge treatment using a discharging lamp so as to be easily cleaned. In addition, after the secondary transfer operation, the surface of the intermediate transfer belt 41 is cleaned with the cleaning brush 42*a* of the belt cleaning device 42, which is attached to the intermediate transfer belt 41 with an attach/detach mechanism. The toner particles collected by the cleaning brush 42*a* are stored in a waste toner tank 49.

Next, the developing device 30 will be explained in detail. The developing device 30 includes the developing unit 31 including the developing sleeve 31*a* configured to bear the toner thereon while rotating and the first paddle 31*d* which rotates to scoop and agitate the toner; and the toner cartridge 32 configured to contain the toner therein. The reason why the developing device 30 is constituted of these two separable units is that the developing unit 31 has a durability several times that of the toner cartridge, i.e., the developing device can be used without a problem even if the toner cartridge is replaced several times.

Figure 12:
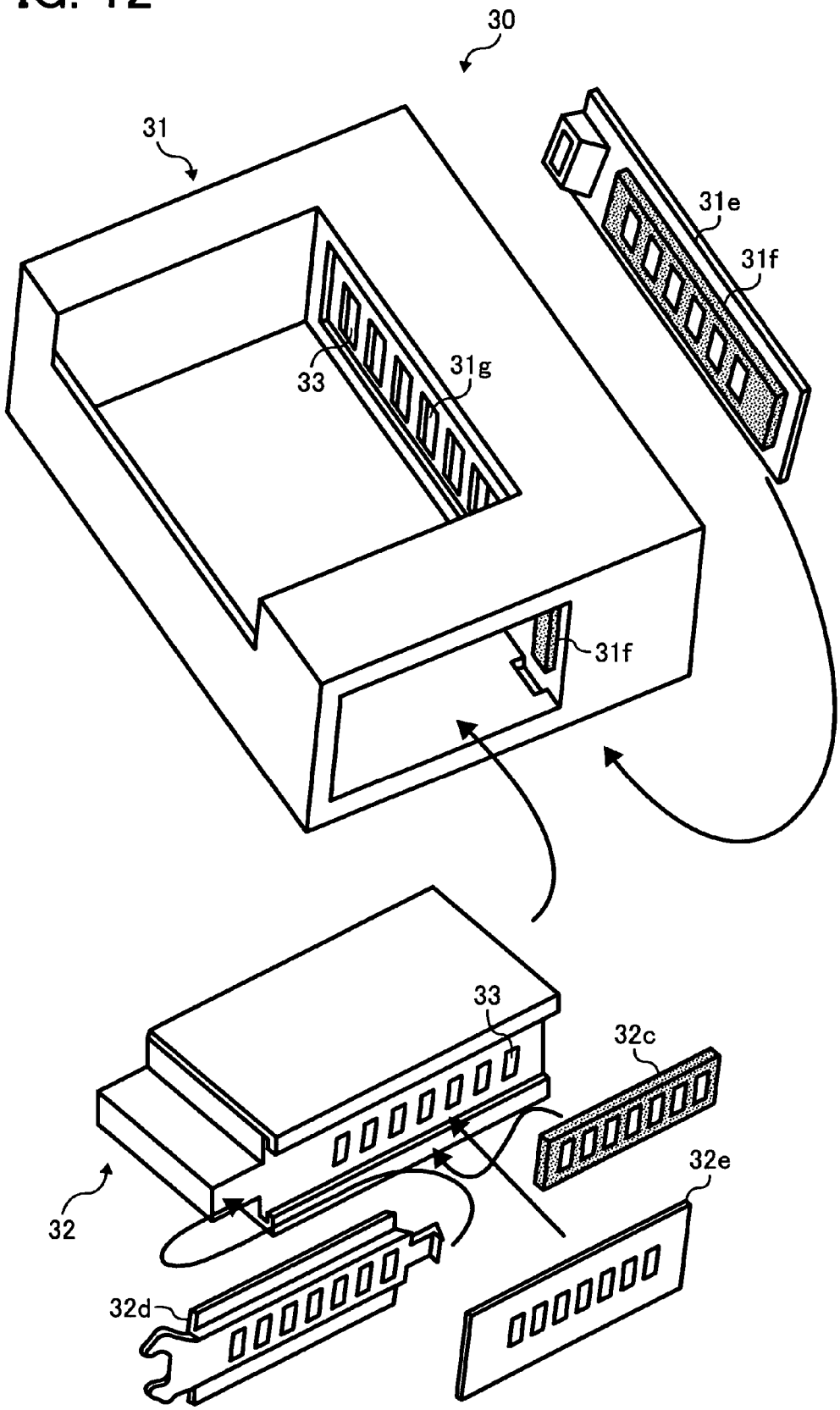
FIG. 12 is a schematic view for explaining how the openings (i.e., a passage) are formed between the cartridge and the developing unit.

FIG. 12 is a schematic view for explaining the openings 33 of the developing device 30. The developing unit 31 has a slide shutter 31*e* having an elastic member 31*f* which is adhered to the slide shutter 31*e*. By opening or shutting the shutter 31*e*, the openings 33 are opened or shut. On the other hand, the toner cartridge 32 has an elastic member 32*c* having openings corresponding to the openings 33 formed on the main body of the cartridge 32; a slide shutter 32*d* configured to shut (to prevent the toner from escaping) or open the openings 33 (to supply the toner to the developing device 31); and a fixing seal 32*e* configured to fix the elastic member 32*c* and the shutter 32*d*.

Specifically, after the toner cartridge 32 is set to the developing unit 31, the shutters 31*e* and 32*d* are opened so that the toner in the toner cartridge 32 can be supplied to the developing device 31 through the openings 33.

The developing unit 31 has plural openings 33. In addition, the slide shutter 31*e* to which an elastic member 31*f* is adhered is provided between the developing unit 31 and the toner cartridge 32. By sliding the shutter 31*e*, the openings 33 are opened or shut. When a toner cartridge is not connected with the developing device 31 or the developing device is not set in the image forming apparatus, the openings 33 are shut by the slide shutter 31*e* to prevent the toner therein from escaping.

In addition, in order that the toner in the toner cartridge 32 is prevented from escaping when the toner cartridge is not set in the developing device or the image forming apparatus, the slid shutter 32*d* is provided on the toner cartridge. Not only the slide shutter 32*d* but also the elastic member 32*c*, and fixing seal 32*e* are provided on the toner cartridge 32. The elastic member 32*c* is preferably made of an elastic material such as foam urethane resins and foam silicone resins As illustrated in FIG. 12, the slide shutters 31*e* and 32*d* have openings corresponding to the respective openings 33 of the toner cartridge 32 and the developing device 31. When the openings 33 are shut, the slide shutters are moved so that the openings 33 face the wall of the shutters. When it is desired to open the openings 33, the slide shutters are moved so that the openings 33 face the windows of the shutters. Thus, the openings 33 can be formed.

The operations of the developing device 30 of the image forming apparatus 1 of the present invention is the same as those of the developing device mentioned above.

Specifically, the first paddle 31*d* of the developing unit 31 feeds the toner to the developer supply roller 31*b* while agitating the toner. The toner supplying roller 31*b* rubs the developing sleeve 31*a* and the toner to frictionally charge the toner. The thus charged toner is borne on the surface of the developing sleeve 31*a* by an image force. The toner layer thickness control roller 31*c* controls the thickness of the toner layer and the toner layer is transported to the developing region. As illustrated in FIG. 11, electrostatic images are developed at the developing region with the toner layer formed on the developing sleeve 31*a* while a developing bias is applied between the photoreceptor belt 11 and the developing sleeve 31*a*.

As mentioned above, the toner rubbed by the toner supply roller 31*b* at the developing sleeve 31*a* receives a large pressure, and thereby the roughened surface of the toner particles is cut or the external additive thereon is embedded into the toner particles. Therefore, the surface of the toner particles is smoothed, resulting in increase of the adhesiveness of the toner particles and decrease of the fluidity of the toner particles. In this case, the charging ability of the toner particles deteriorates because the external additive is embedded into the toner particles. As a result, the developability, transferability and cleanability of the toner deteriorate.

Thus, the amount of such deteriorated toner particles increases in the hopper 311, and in addition the amount of the toner particles in the developing unit 31 decreases. In this case, the toner in the toner cartridge 32 is replenished to the developing unit 31. The toner cartridge 32 has the second paddle 32*a* which rotates while the tip thereof is contacted with the inner surface of the first toner storage room 321 and the third paddle 32*b* which rotates while the tip thereof is contacted with the inner surface of the second toner storage room 322. When the second and third paddles 32*a* and 32*b* are rotated, the toner in the toner cartridge 32 is transported to the developing unit 31 through the openings 33.

In addition, the toner particles in the developing unit 31 are returned to the toner cartridge 32 through the openings 33, and thereby the toner in the developing unit 31 is mixed with the toner in the toner cartridge 32. Since a large amount of unused toner particles are present in the toner cartridge 32, the external additive on such unused toner particles is re-distributed on the deteriorated toner particles. In addition, the deteriorated toner particles which have a relatively large particle diameter are mixed with unused toner particles having a relatively small particle diameter, and thereby the average particle diameter of the toner is decreased. Therefore, the charging property and the fluidity of the deteriorated toner particles are changed so as to be similar to those of the unused toner particles.

Thus, the toner particles in the developing unit 31 are discharged to the fist toner storage room 321 and the toner particles are further fed to the second toner storage room 322 with the second paddle 32*a*. The toner particles are then fed back to the first toner storage room 321 with the third paddle 32*b*. During this toner transportation, the external additive on the unused toner particles is re-transferred to the surface of the deteriorated toner particles, resulting in revival of the deteriorated toner particles.

The mixture of the thus revived toner particles and unused toner particles is supplied again to the developing unit 31 from the first toner storage room 321. The toner particles thus transported to the developing unit 31 are used for developing electrostatic images. Therefore, high quality images can be produced for a long period of time.

The toner for use in the image forming apparatus of the present invention will be explained. The toner includes at least a binder resin, a colorant and a charge controlling agent.

Binder Resin (Polyester Resin)

Polyester resins are preferably used as the binder resin of the toner for use in the present invention because of imparting good coloring property and high mechanical strength to color toner images. In order to form secondary or tertiary color images, a plurality of different color toner layers (such as yellow, magenta and cyan toner layers) are overlaid. In this regard, if the toner layers have low mechanical strength, problems in that the toner images are cracked or have defective portions; and the toner images have low glossiness occur. By using polyester resins, such problems can be avoided.

Polyester resins are typically prepared by subjecting a polyhydric alcohol and a polycarboxylic acid to an esterification reaction.

Specific examples of the polyhydric alcohols include diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol and 1,6-hexanediol; bisphenols and derivatives thereof such as bisphenol A, hydrogenated bisphenol A, and alkylene oxide adducts of bisphenol A (e.g., polyoxypropylenated bisphenol A); other dihydric alcohols.

Specific examples of the polyhydric alcohols having three or more hydroxyl groups include sorbitol, 1,2,3,6-hexanetetrol, 1,4-sorbitane, pentaerythritol, dipentaerythritol, tripentaerythritol, 1,2,4-butanetriol, 1,2,5-pentanetriol, glycerol, 2-methylpropanetriol, 2-metyl-1,2,4-butanetriol, trimethylol ethane, trimethylol propane, 1,3,5-trihydroxymethyl benzene, oxyalkylene ethers of novolac type phenolic resins, and other tri- or more-hydric alcohols. The polyhydric alcohols having three or more hydroxyl groups are used as crosslinking components.

Among these alcohols, alkylene oxide adducts of bisphenol A are preferably used as main components. When such alcohols are used, the resultant polyester resins have a relatively high glass transition temperature, and a good combination of blocking resistance and high temperature preservability can be imparted to the toner. In addition, the alkyl groups present on both sides of the bisphenol A molecule serve as soft segments, and thereby a good combination of coloring property and physical strength can be imparted to the toner. Among the alkylene oxide adducts of bisphenol A, ethylene oxide adducts and propylene oxide adducts of bisphenol A are preferably used.

Suitable acid components for use in the polyester resins include dicarboxylic acids and polycarboxylic acids having three or more carboxyl groups.

Specific examples of the dicarboxylic acids include maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid, alkenyl succinic acids (e.g., n-dodecenyl succinic acid), alkyl succinic acids (e.g., n-dodecyl succinic acid), anhydrides and alkyl esters of these acids, etc. Specific examples of the tri- or more-carboxylic acids include 1,2,4-benzene tricarboxylic acid, 2,5,7-naphthalene tricarboxylic acid, 1,2,4-naphthalene tricarboxylic acid, 1,2,4-butane tricarboxyic acid, 1,2,5-hexane tricarboxyic acid, 1,3-dicarboxyl-2-methyl-2-methylenecarboxylpropane, tetra(methylenecarboxyl)methane, and 1,2,7,8-octane tetracarboxylic acid; anhydrides, alkyl esters, alkenyl esters, and aryl esters of these acids; and other tri- or more-carboxylic acids. Specific examples of the tricarboxylic acids and esters thereof include 1,2,4-benzene tricarboxylic acid, 1,2,4-benzene tricarboxylic acid trimethyl ester, 1,2,4-benzenetricarboxylicacidtriethyl ester, 1,2,4-benzene tricarboxylic acid tri-n-butyl ester, 1,2,4-benzene tricarboxylic acid tri-iso-butyl ester, 1,2,4-benzene tricarboxylic acid tri-n-octyl ester, 1,2,4-benzene tricarboxylic acid tri-2-ethylhexyl ester, 1,2,4-benzene tricarboxylic acid tri-benzyl ester, 1,2,4-benzene tricarboxylic acid tris(4-isopropylbenzyl)ester, etc.

The polyester resins for use in the toner for use in the present invention preferably include no tetrahydrofuran (THF)-insoluble components, and have a molecular weight distribution property such that components having a molecular weight of not greater than 500 are included in an amount of not greater than 4% by weight, and more preferably from 1 to 4% by weight, and a peak is present in a molecular weight range of from 3,000 to 9,000. Polyester resins including THF-insoluble components are used, the glossiness and transparency of the resultant toner images deteriorate and thereby high quality images so as to be used for overhead projection (OHP) sheets cannot be formed. In addition, since the content of components having a molecular weight of not greater than 500 is not greater than 4% by weight, occurrence of problems such that the toner is adhered to other materials such as image forming members, and the toner is pulverized in developing devices, resulting in deterioration of image qualities can be prevented. Therefore, the toner can be stably used as a non-magnetic developer for a long period of time even when used while a fresh toner is replenished thereto. It is preferable that the content of components having a molecular weight of not greater than 500 is as low as possible. However, it is hard to prepare such polyester resins, and the costs for manufacturing such polyester resins are high. Therefore, the lower limit of the content of components having a molecular weight of not greater than 500 is about 1% by weight in view of productivity.

In the present application, the molecular weight distribution of a resin was determined by gel permeation chromatography (GPC). The method is as follows.

1) the column is allowed to settle in a chamber heated to 40° C. so as to be stabilized;

2) tetrahydrofuran (THF) is passed through the column thus heated to 40° C. at a flow rate of 1 ml/min; and 3) then 200 μl of a tetrahydrofuran (THF) solution of a resin having a solid content of from 0.05 to 0.6% by weight is injected to the column to obtain a molecular distribution curve of the resin.

The THF resin solution of the resin was prepared by the following method:

i) the resin is dissolved in tetrahydrofuran to prepare a THF solution of the resin;

ii) the resin solution (or dispersion) is subjected to filtering using a filter having openings with a diameter of 0.45 μm for use in liquid chromatography to remove THF-insoluble components therefrom.

The molecular weight distribution of the resin is determined using a working curve which represents the relationship between weight and GPC counts and which is previously prepared using monodisperse polystyrenes. Specific examples of the molecular weights of the monodisperse polystyrenes include $6\times10^2$, $2.1\times10^3$, $4\times10^3$, $1.75\times10^4$, $1.1\times10^5$, $3.9\times10^5$, $8.6\times10^5$, $2\times10^6$, and $4.48\times10^6$. The monodisperse polystyrenes are available from Pressure Chemical Co., or Tosoh Corp. It is preferable to prepare a working curve using ten or more kinds of monodisperse polystyrenes. In measurements, it is preferable to use a RI (refractive index) detector as the detector.

Whether or not a binder resin includes THF-insoluble components can be determined by discharging the resin solution from a syringe, on the nozzle of which the filter having openings with a diameter of 0.45 μm is set, and then observing the filter to determine whether the filter is clogged with insoluble materials. If the filter is not clogged, the binder resin is considered to include no THF-insoluble components.

The polyester resins for use in the toner for use in the present invention preferably have a glass transition temperature of from 55 to 70° C. The method for measuring the glass transition temperature of a resin is measured by a TG-DSC system TAS-100 manufactured by RIGAKU CORPORATION. The procedure for measurements of glass transition temperature is as follows:

1) about 10 mg of a sample is contained in an aluminum container, and the container is set on a holder unit;
2) the holder unit is set in an electrical furnace, and the sample is heated from room temperature to 150° C. at a temperature rising speed of 10° C./min;
3) after the sample is allowed to settle at 150° C. for 10 minutes, the sample is cooled to room temperature; and
4) after the sample is allowed to settle at room temperature for 10 minutes, the sample is heated again from room temperature to 150° C. under a nitrogen atmosphere at a temperature rising speed of 10° C./min to perform a DSC measurement.

The glass transition temperature of the sample was determined using an analysis system of the TAS-100 system. Namely, the glass transition temperature is defined as the contact point between the tangent line of the endothermic curve at the temperatures near the glass transition temperature and the base line of the DSC curve.

(Charge Controlling Agent)

Charge controlling agents are typically included in the toner to impart a positive or negative charge to the toner, which is determined depending on the charges to be formed on the surface of the image bearing member (e.g., photoreceptors). Suitable materials for use as negative charge controlling agents include resins and compounds having an electron donating group, azo dyes, metal complexes of organic acids, etc.

Specific examples of the marketed negative charge controlling agents include BONTRON S-31, S-32, S-34, S-36, S-37, S-39, S-40, S-44, E-81, E-82, E-84, E-86, E-88, A, 1-A, 2-A, and 3-A (which are manufactured by Orient Chemical Industries Co., Ltd.); KAYACHARGE N-1 and N-2, and KAYASET BLACK T-2 and 004 (which are manufactured by Nippon Kayaku Co., Ltd.); AIZEN SPIRON BLACK T-37, T-77, T-95, TRH and TNS-2 (which are manufactured by Hodogaya Chemical Co., Ltd.); FCA-1001-N, FCA-1001-NB, and FCA-1001-NZ (which are manufactured by Fujikura Kasei Co., Ltd.); etc.

Suitable materials for use as positive charge controlling agents include basic compounds such as Nigrosine dyes, cationic compounds such as quaternary ammonium salts, metal salts of high fatty acids, etc. Specific examples of the marketed positive charge controlling agents include BONTRON N-01, N-02, N-03, N-04, N-05, N-07, N-09, N-10, N-11, N-13, P-51, P-52 and AFP-B (which are manufactured by Orient Chemical Industries Co., Ltd.; TP-302, TP-415, and TP-4040 (which are manufactured by Hodogaya Chemical Co., Ltd.); COPY BLUE PR, and COPY CHARGE PX-VP-435 and NX-VP-434 (which are manufactured by Hoechst A.G.); FCA 201, 201-B-1, 201-B-2, 201-B-3, 201-PB, 201-PZ, and 301 (which are manufactured by Fujikura Kasei Co., Ltd.); PLZ 1001, 2001, 6001 and 7001 (which are manufactured by Shikoku Chemicals Corp.); etc.

Among these charge controlling agents, metal salts of salicylic acid are preferably used because of having the following advantages:

(1) fresh toner particles replenished from a toner supplying mechanism to a developing device can be quickly charged (i.e., the toner has quick charge rising property); and (2) even when stresses are applied to the toner for a long period of time, the toner can maintain a sharp charge quantity distribution.

The added amount of a charge controlling agent in the toner is from 0.5 to 5.0% by weight, and preferably from 1.5 to 3.0% by weight, based on the weight of the toner particles. When the added amount is too small, it is difficult for the toner to maintain a large amount of charges. In contrast, when the added amount is too large, the charge controlling agent cannot be well dispersed in a binder resin. In this case, the toner causes image problems such as background development in that the background area of an image is soiled with toner particles when the toner is used for a long period of time.

(External Additive)

One or more external additives such as inorganic materials (e.g., metal oxides) can be externally added to the toner to improve the properties of the toner such as fluidity, and charging properties. In order to improve the hydrophobicity and charging properties of inorganic materials, the surface of inorganic materials is preferably treated with a material such as silane coupling agents, titanate coupling agents, silicone oils, fluorine-containing compounds and organic acids such as higher fatty acids, or covered with a resin.

Specific examples of the inorganic materials include silicon dioxide (silica), titanium dioxide (titania), aluminum oxide, zinc oxide, magnesium oxide, cerium oxide, iron oxide, copper oxide, tin oxide, chromium oxide, antimony oxide, zirconium oxide, barium titanate, magnesium titanate, calcium titanate, strontium titanate, barium sulfate, barium carbonate, calcium carbonate, silicon carbide, silicon nitride, etc. Among these inorganic materials, silica and titanium oxide which are reacted with an organic silicon compound such as dimethyldichlorosilane, hexamethyldisilazane, and silicone oils are preferably used. When silica is thus treated, the silanol groups present on the surface thereof are substituted with organic groups and thereby good hydrophobicity can be imparted to the silica.

Inorganic materials serving as external additives are preferably present on the surface of toner particles in an amount of from 1.3 to 3.2 parts by weight based on 100 parts by weight of the toner particles.

In addition, particulate organic materials can also be used as external additives. Specific examples of the organic materials include polystyrene resins, and copolymers of methacrylates and acrylates, which are prepared by a polymerization method such as soap-free emulsion polymerization methods, suspension polymerization methods, and dispersion polymerization methods; polycondensation polymers such as silicone resins, benzoguanamine resins, and nylon resins; and thermosetting resins.

In order to improve the hydrophobicity and charging properties of inorganic materials (i.e., to prevent deterioration of fluidity and charging properties of the toner particularly under high humidity conditions), the surface of the inorganic materials is preferably treated with a material such as silane coupling agents, titanate coupling agents, silicone oils, fluorine-containing compounds and organic acids such as higher fatty acids, or covered with a resin.

Silane coupling agents are used for improving the hydrophobicity and fluidity of the toner. Specific examples of the silane coupling agents include chlorosilane, alkoxysilane, silazane, silylating agents, etc. Among these silane coupling agents, alkoxysilane is preferably used. Specific examples of the alkoxysilane include vinyltrimethoxysilane, propyltrimethoxysilane, iso-butyltrimethoxysilane, n-butyltrimethoxysilane, n-hexyltrimethoxysilane, n-octyltrimethoxysilane, n-dodecyltrimethoxysilane, etc.

Specific examples of the silicone oils for use in treating the external additives include polydimethylsiloxane, polymethylphenylsiloxane, polydiphenylsiloxane, etc.

Suitable materials for use as the fluorine-containing compounds used for treating the external additives include organic silicon compounds having a fluorine atom. Specific examples of such fluorine-containing compounds include 3,3,4,4,5,5,6,6,6-nonafluorohexyltrichlorosilane, 3,3,3-trifluoropropyltrimethoxysilane, methyl-3,3,3-trifluoropropyldichlorosilane, dimethoxymethyl-3,3,3-trifluoropropylsilane, 3,3,4,4,5,5,6,6,6-nonafluorohexylmethyldichlorosilane, etc.

Specific examples of the higher fatty acids and their derivatives for use in treating the external additives include stearic acid, oleic acid, palmitic acid, linoleic acid, zinc stearate, aluminum stearate, copper stearate, magnesium stearate, calcium stearate, zinc oleate, manganese oleate, zinc palmitate, zinc linoleate, calcium linoleate, etc.

It is preferable to add two or more external additives which have different particle diameters. In this regard, it is preferable that the average particle diameter of a larger external additive is from 2 to 5 times that of the average particle diameter of a smaller external additive. In this case, a problem in that an external additive is embedded into toner particles, resulting in deterioration of the fluidity of the toner and thereby uneven-density images are formed can be avoided and in addition formation of abnormal images such as image omissions due to increase of adhesiveness of the toner can be avoided. In addition, a problem in that free external additive particles released from the toner particles damage a photoreceptor can also be avoided. By including such two or more kinds of external additives having different particle diameters, the larger external additive serves as a spacer, thereby preventing the smaller external additive, which serves as a fluidizer, from being embedded into the toner particles. Therefore, the toner can maintain good fluidity. In addition, the thickness of the toner layer on a developer bearing member (such as developing sleeves) becomes uniform even after long repeated use, although the reason therefor is not yet determined yet.

In this regard, it is preferable for the larger external additive to have a BET specific surface area of from 30 to 80 $m^2/g$, and more preferably from 40 to 60 $m^2/g$. When the specific surface area is too small, the fluidity of the toner deteriorates, and thereby uneven-density images are formed and in addition abnormal images such as image omissions are formed due to increase of adhesiveness of the toner. In addition, a problem in that free external additive particles released from the toner particles damage a photoreceptor is also caused. The added amount of such a larger external additive is from 0.1 to 3.0 parts by weight, and preferably from 0.8 to 2.0 parts by weight, per 100 parts by weight of the toner particles. When the added amount is too small, a problem in that toner images are not well transferred to a receiving material, resulting in formation of abnormal images is caused. In contrast, when the added amount is too large, the external additive is easily released from the toner particles, and thereby problems in that free external additive particles released from the toner particles damage a photoreceptor, and the resultant images have omissions are caused.

The smaller external additive preferably has a BET specific surface area of from 100 to 250 $m^2/g$, and more preferably from 120 to 200 $m^2/g$. When the specific surface area is in this range, the adhesiveness of the toner can be decreased. The added amount of such a small external additive is preferably from 0.1 to 3 parts by weight, and more preferably from 0.5 to 1.5 parts by weight, per 100 parts by weight of the toner particles. When the added amount is too small, the effect (i.e., fluidity) of the external additive cannot be produced. In contrast, when the added amount is too large, the amount of free particles which are released from the toner particles increases, and thereby a problem in that free external additive particles released from the toner particles damage a photoreceptor is caused.

(Colorant)

Known dyes and pigments can be used as the colorant of the toner for use in the present invention.

Specific examples of the dyes and pigments include blackish colorants such as carbon black, Nigrosine dyes, and black iron oxide; yellowish colorants such as NAPHTHOL YELLOW S, HANSA YELLOW 10G, HANSA YELLOW 5G, HANSA YELLOW G, Cadmium Yellow, yellow iron oxide, loess, chrome yellow, Titan Yellow, polyazo yellow, Oil Yellow, HANSA YELLOW GR, HANSA YELLOW A, HANSA YELLOW RN, HANSA YELLOW R, PIGMENT YELLOW L, BENZIDINE YELLOW G, BENZIDINE YELLOW GR, PERMANENT YELLOW NCG, VULCAN FAST YELLOW 5G, VULCAN FAST YELLOW R, Tartrazine Lake, QUINOLINE YELLOW LAKE, ANTHRAZANE YELLOW BGL, and isoindolinone yellow; reddish colorants (for use in magenta colorants) such as red iron oxide, red lead, orange lead, cadmium red, cadmium mercury red, antimony orange, Permanent Red 4R, Para Red, Fire Red, p-chloro-o-nitroaniline red, Lithol Fast Scarlet G. Brilliant Fast Scarlet, BRILLIANT CARMINE BS, PERMANENT RED F2R, PERMANENT RED F4R, PERMANENT RED FRL, PERMANENT RED FRLL, PERMANENT RED F4RH, Fast Scarlet VD, VULCAN FAST RUBINE B, BRILLIANT SCARLET G, LITHOL RUBINE GX, PERMANENT RED F5R, BRILLIANT CARMINE 6B, Pigment Scarlet 3B, Bordeaux 5B, Toluidine Maroon, PERMANENT BORDEAUX F2K, HELIO BORDEAUX BL, BORDEAUX 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, and Oil Orange; bluish colorants (for use in cyan colorants) cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS, INDANTHRENE BLUE BC, Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green; and other colorants such as titanium oxide, zinc oxide, lithopone and the like. These materials are used alone or in combination.

The content of the colorant in the toner is preferably from 0.1 to 50 parts by weight, per 100 parts by weight of the binder resin included in the toner.

It is preferable to treat the surface of the colorants with the binder resins mentioned above, to enhance the dispersibility of the colorants in the binder resins. In this case, the resultant toner has good combination of coloring property, transparency and charging properties. Such a treatment can be performed by a method in which a binder resin and a colorant are mixed at a certain ratio and the mixture is heated and kneaded, followed by cooling and pulverization. The mixing ratio (R/C) of the resin (R) to the colorant (C) is generally from 1/1 to 5/1 by weight. When the ratio is too small, it is difficult to well disperse the colorant in the resin. In contrast, when the ratio is too large, it is also difficult to well disperse the colorant in the resin because a high shearing force cannot be applied to the colorant. When two or more kinds of colorants are used, both of a dispersing method in which each of the colorants is dispersed in a resin and then the kneaded mixtures are mixed, and a dispersing method in which both the colorants are dispersed in a resin and the mixture is kneaded can be used.

(Wax)

A release agent such as waxes can be included in the toner to impart good releasability to the toner. Specific examples of the release agents include solid paraffin waxes, microcrystalline waxes, rice waxes, fatty acid amide waxes, fatty acid based waxes, monoketone compounds of fatty acids, fatty acid metal salt type waxes, fatty acid ester type waxes, partially-saponified fatty acid ester type waxes, silicone varnishes, carnauba waxes, etc. In addition, low molecular weight polyolefins such as polyethylene, and polypropylene can also be used. The waxes for use in the toner preferably have a melting point of from 40 to 120° C., and more preferably from 50 to 110° C. When the melting point is too high, the toner has poor low temperature fixability. In contrast, when the melting point is too low, the offset resistance and durability of the toner deteriorate. The melting point of waxes can be determined by a differential scanning calorimetric (DSC) method. In particular, polyolefins having a softening point of from 70 to 150° C., and preferably from 120 to 150° C., which is determined by a ring and ball method, are preferably used.

A cleanability improving agent can be included in the toner to impart good cleaning property to the toner, i.e., to well remove toner particles remaining on the image bearing member 11 and the primary transfer medium 41 even after a transferring operation. Specific examples of the cleanability improving agent include fatty acids and metal salts thereof such as stearic acid, zinc stearate, and calcium stearate; particulate polymers such as methyl methacrylate and polystyrene, which are prepared by a polymerization method such as soap-free emulsion polymerization method. Among these particulate polymers, polymers having a volume particle diameter of from 0.01 to 1 μm and a narrow particle diameter distribution are preferably used.

The toner for use in the present invention can be prepared by any known toner manufacturing methods. For example, kneading/pulverization methods including the following processes can be used.

(1) toner constituents including at least a binder resin, a colorant, and a charge controlling agent are mechanically mixed (mixing process);

(2) the mixture is melted and kneaded upon application of heat thereto (kneading process);

(3) the kneaded mixture is cooled and then pulverized (cooling/pulverization process); and (4) the pulverized mixture is subjected to a classification treatment (classification process).

Toner particles having undesired particle diameters removed in the classification process can be reused for the mixing process or the kneading process. The added amount of such toner particles (i.e., by-product) is from 1 to 20 parts by weight per 100 parts by weight of the fresh raw materials.

In the kneading process, continuous kneaders such as single-axis or double-axis kneaders and batch kneaders such as roll mills can be used. Among these kneaders, continuous double-axis extruders such as KTK double-axis extruders manufactured by Kobe Steel, Ltd., TEM double-axis extruders manufactured by Toshiba Machine Co., Ltd., TEX double-axis extruders manufactured by Japan Steel Works, Ltd., PCM double-axis extruders manufactured by Ikegai Corp., and KEX double-axis extruders manufactured by Kurimoto, Ltd., and continuous single-axis kneaders such as KO-KNEADER manufactured by Buss AG are preferably used.

The kneading operation is performed under conditions such that the molecular chains of the binder resin are not cut. Specifically, the kneading temperature is determined while considering the softening point of the binder resin. When the kneading temperature is much higher than the softening point, the molecular chains are seriously cut. In contrast, when the kneading temperature is much lower than the softening point, the materials cannot be well dispersed.

After the kneading process, the kneaded mixture is pulverized. In the pulverization process, it is preferable that the kneaded mixture is at first crushed and then pulverized. When pulverizing the crushed mixture, a method in which the crushed mixture is collided against collision plate using jet air; a method in which the crushed mixture is collided with each other using jet air; and a method in which the crushed mixture is pulverized at a narrow gap between a rotor and a stator, can be preferably used.

After the pulverization process, the pulverized particles are subjected to a classification treatment in circulated air, in which the particles are classified using a centrifugal force, to obtain a toner having an average particle diameter of from 5 to 20 μm.

The thus prepared toner particles are mixed with an external additive (e.g., hydrophobized silica) using a mixer to improve fluidity, preservability, developing properties and transferring properties of the toner particles.

Suitable mixers for use in mixing the toner particles and an external additive include known mixers for mixing powders, which preferably have a jacket to control the inside temperature thereof.

By changing the timing when the external additive is added or the addition speed of the external additive, the stress on the external additive (i.e., the adhesion state of the external additive with the toner particles) can be changed. Of course, by changing rotation number of the blade of the mixer used, mixing time, mixing temperature, etc., the stress can also be changed.

In addition, a mixing method in which at first a relatively high stress is applied and then a relatively low stress is applied to the external additive, or vice versa, can also be used.

Specific examples of the mixers include V-form mixers, locking mixers, LOEDGE MIXER, NAUTER MIXER, HENSCHEL MIXER and the like mixers.

After adding an external additive to the toner particles, the mixture is sieved, for example, using a screen with 250-mesh, to remove coarse particles and aggregated particles.

The thus prepared toner is used as a non-magnetic one-component developer. However, it is possible to use the toner as a magnetic one-component developer by including a magnetic material in the toner.

In the toner preparation method mentioned above, the charge quantity distribution parameter can be adjusted by changing the melting/kneading conditions of the toner composition mixture to change the dispersing state of the charge controlling agent in the binder resin. Specifically, the following conditions are preferably adjusted.

(1) The content of the charge controlling agent in the toner composition mixture;

(2) The time for which the toner composition mixture is kneaded; and (3) The mixing torque and temperature at which the toner composition mixture is kneaded.

The method for manufacturing the toner for use in the present invention is not limited to the kneading/pulverization methods, and polymerization methods can also be used.

Among various polymerization methods, a method in which a toner composition liquid which is prepared by dissolving or dispersing at least a polymer having a group reactive with a compound having an active hydrogen atom, a polyester resin, a colorant, and a release agent in an organic solvent, and then subjecting the toner composition liquid to a crosslinking reaction and/or a polymer chain growth reaction in an aqueous medium can be preferably used.

(Modified Polyester Resin)

A modified polyester resin (i) can be preferably used as a binder resin of the toner. The modified polyester resin is defined as polyester resins which include a bonding group other than the ester bond and functional groups of monomer units such as alcohols and acids, and resins in which a resin unit other than polyester resin units is bonded with polyester units through a covalent bond and an ionic bond. For example, polyester resins which are prepared by the following method can be preferably used as the modified polyester:

(1) a functional group such as isocyanate groups which can react with an acid group and a hydroxyl group is incorporated in an end portion of a polyester resin; and
(2) the polyester resin is further reacted with a compound having an active hydrogen so that the end portion thereof is modified or extended.

Suitable resins for use as the modified polyester resin include urea-modified polyester resins which are prepared by reacting a polyester prepolymer (A) having an isocyanate group with an amine (B). Suitable materials for use as the polyester prepolymer (A) including an isocyanate group include polyester prepolymers which are prepared by reacting a polycondensation product of a polyol (1) with a polycarboxylic acid (2), which has an active hydrogen, with a polyisocyanate (3). Specific examples of the groups having an active hydrogen include hydroxyl groups (such as alcoholic hydroxyl groups and phenolic hydroxyl groups), amino groups, carboxyl groups, mercapto groups, etc. Among these groups, alcoholic hydroxyl groups are preferable.

Suitable polyols (1) include diols (1-1) and polyols (1-2) having three or more hydroxyl groups. Preferably diols (1-1) or mixtures of a diol (1-1) with a small amount of a polyol (1-2) are used.

Specific examples of the diols (1-1) and polyols include the compounds mentioned above for use in the polyester resins.

Suitable polycarboxylic acids include dicarboxylic acids (2-1) and polycarboxylic acids (2-2) having three or more carboxyl groups. Preferably, dicarboxylic acids (2-1) or mixtures in which a small amount of a polycarboxylic acid (2-2) is added to a dicarboxylic acid (2-1) are used.

Specific examples of the dicarboxylic acids (2-1) and tricarboxylic acids include the compounds mentioned above for use in the polyester resin.

Suitable mixing ratio (i.e., an equivalence ratio [OH]/[COOH]) of a polyol (1) to a polycarboxylic acid (2) is from 2/1 to 1/1, preferably from 1.5/1 to 1/1 and more preferably from 1.3/1 to 1.02/1.

The polyhydric alcohols (1) and the polycarboxylic acids (2) are not limited to the compounds mentioned above for use in the polyester resin, and any other compounds which can form a polyester having an active hydrogen atom using a polycondensation reaction can be used.

Specific examples of the polyisocyanates (3) include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic didicosycantes (e.g., tolylene diisocyanate and diphenylmethane diisocyanate); aromatic aliphatic diisocyanates (e.g., $\alpha,\alpha,\alpha',\alpha'$-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

Suitable mixing ratio (i.e., [NCO]/[OH]) of a polyisocyanate (3) to a polyester having a hydroxyl group is from 5/1 to 1/1, preferably from 4/1 to 1.2/1 and more preferably from 2.5/1 to 1.5/1. When the [NCO]/[OH] ratio is too large, the low temperature fixability of the toner deteriorates. In contrast, when the ratio is too small, the content of the urea group in the modified polyesters decreases and thereby the hot-offset resistance of the toner is deteriorated.

The content of the unit obtained from a polyisocyanate (3) in the polyester prepolymer (A) having a polyisocyanate group at its end portion is from 0.5 to 40% by weight, preferably from 1 to 30% by weight and more preferably from 2 to 20% by weight. When the content is too low, the hot offset resistance of the toner deteriorates and in addition the heat resistance and low temperature fixability of the toner also deteriorate. In contrast, when the content is too high, the low temperature fixability of the toner deteriorates.

The number of the isocyanate group included in a molecule of the polyester prepolymer (A) is not less than 1, preferably from 1.5 to 3 and more preferably from 1.8 to 2.5. When the number of the isocyanate group is too small, the molecular weight of the resultant urea-modified polyester decreases and thereby hot offset resistance is deteriorated.

Specific examples of the amines (B) include diamines (B1), polyamines (B2) having three or more amino groups, amino alcohols (B3), aminomercaptans (B4), aminoacids (B5) and blocked amines (B6) in which the amines (B1-B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc.

Specific examples of the polyamines (B2) having three or more amino groups include diethylene triamine and triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids include amino propionic acid and amino caproic acid. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc. Among these compounds, diamines (B1) and mixtures of a diamine with a small amount of a polyamine (B2) are preferable.

The mixing ratio (i.e., a ratio [NCO]/[NHx]) of the prepolymer (A) having an isocyanate group to the amine (B) is from 1/2 to 2/1, preferably from 1.5/1 to 1/1.5 and more preferably from 1.2/1 to 1/1.2. When the mixing ratio is too low or too high, the molecular weight of the resultant urea-modified polyester decreases, resulting in deterioration of the hot offset resistance of the resultant toner.

The urea-modified polyesters may include a urethane bond as well as a urea bond. The molar ratio (urea/urethane) of the urea bond to the urethane bond is from 100/0 to 10/90, preferably from 80/20 to 20/80 and more preferably from 60/40 to 30/70. When the content of the urea bond is too low, the hot offset resistance of the resultant toner deteriorates.

The modified polyester resins (i) for use in the present invention are prepared by a one-shot method or a prepolymer method.

The weight average molecular weight of the urea-modified polyester resins for use in the toner is generally not less than 10,000, preferably from 20,000 to 10,000,000, and more preferably from 30,000 to 1,000,000.

In this regard, the peak molecular weight of the urea-modified polyester resins is preferably from 1,000 to 10,000. When the peak molecular weight is too low, the polymer chain growth reaction is not well performed, and therefore the toner has poor elasticity, resulting in deterioration of the hot offset resistance of the toner. In contrast, when the peak molecular weight is too high, the fixability of the toner deteriorates, and it becomes difficult to prepare a toner using a pulverization method or a polymerization method.

The number average molecular weight of the urea-modified polyesters (i) is not particularly limited (i.e., the weight average molecular weight should be primarily controlled so as to be in the range mentioned above) when an unmodified polyester resin (ii) (which is mentioned below) is used in combination therewith. Namely, controlling of the weight average molecular weight of the modified polyester resins has priority over controlling of the number average molecular weight thereof. However, when a urea-modified polyester (i) is used alone, the number average molecular weight is generally not greater than 20,000, preferably from 1,000 to 10,000, and more preferably from 2,000 to 8,000. When the number average molecular weight is too high, the low temperature fixability of the resultant toner deteriorates, and in addition the glossiness of full color images decreases when the toner is used for color toners.

In the synthesis process of the urea-modified polyester resin (i), a molecular weight controlling agent can be used to control the molecular weight of the modified polyester resin. Specific examples of such a molecular weight controlling agent include monoamines (e.g., diethyl amine, dibutyl amine, butyl amine and lauryl amine) and blocked amines of the amines (such as ketimine compounds).

(Unmodified Polyester Resin)

It is preferable to use a combination of a urea-modified polyester resin (i) with an unmodified polyester resin (ii) as the binder resin. By using a combination of a urea-modified polyester resin with an unmodified polyester resin, the low temperature fixability of the toner can be improved and in addition the toner can produce color images having a high glossiness.

Suitable unmodified polyester resins (i) include polycondensation products of a polyol (1) with a polycarboxylic acid (2). Specific examples of the polyol (1) and polycarboxylic acid (2) are mentioned above for use in the modified polyester resins (i). In addition, specific examples of the suitable polyol and polycarboxylic acid are also mentioned above.

In addition, as the unmodified polyester resins (ii), polyester resins modified by a bond (such as urethane bond) other than a urea bond, can also be used as well as the unmodified polyester resins mentioned above.

When a combination of a modified polyester resin (i) with an unmodified polyester resin (ii) is used as the binder resin, it is preferable that the modified polyester resin at least partially mixes with the unmodified polyester resin to improve the low temperature fixability and hot offset resistance of the toner. Namely, it is preferable that the modified polyester resin has a molecular structure similar to that of the unmodified polyester resin. The mixing ratio (i/ii) of a modified polyester resin (i) to an unmodified polyester resin (ii) is from 5/95 to 80/20, preferably from 5/95 to 30/70, more preferably from 5/95 to 25/75, and even more preferably from 7/93 to 20/80. When the addition amount of the modified polyester resin is too small, the hot offset resistance of the toner deteriorates and in addition, it is impossible for the toner to achieve a good combination of high-temperature preservability and low temperature fixability.

The peak molecular weight of the unmodified polyester resins (ii) is from 1,000 to 10,000, preferably from 2,000 to 8,000 and more preferably from 2,000 to 5,000. When the peak molecular weight of the unmodified polyester resin is too low, the high-temperature preservability deteriorates. When the peak molecular weight thereof is too high, the low temperature fixability deteriorates.

The unmodified polyester resin (ii) preferably has a hydroxyl value not less than 5 mgKOH/g, and more preferably from 10 to 120 mgKOH/g, and even more preferably from 20 to 80 mgKOH/g. When the hydroxyl value is too low, the resultant toner has poor preservability and poor low temperature fixability.

The unmodified polyester resin (ii) preferably has an acid value of from 1 to 5 mgKOH/g, and more preferably from 2 to 4 mgKOH/g. When an unmodified polyester resin (ii) having an acid value in this range is used, the resultant toner has good chargeability and good fixability.

The unmodified polyester resin (ii) to be included in the toner for use in the image forming apparatus of the present invention preferably has a glass transition temperature (Tg) of from 35 to 70° C. and more preferably from 55 to 65° C. When the glass transition temperature is too low, the preservability of the toner deteriorates. In contrast, when the glass transition temperature is too high, the low temperature fixability deteriorates. When the toner includes a combination of a urea-modified polyester resin and an unmodified polyester resin, the toner has relatively good preservability compared to conventional toners including a polyester resin as a binder resin even when the glass transition temperature of the toner of the present invention is lower than the polyester resin included in the conventional toners.

The toner prepared by a polymerization method can include a charge controlling agent, a release agent, and a colorant. Specific examples thereof include the materials mentioned above for use in the toner prepared by a kneading/pulverization method.

Next, a polymerization method suitable for use in preparing the toner for use in the present invention will be explained. However, the polymerization method is not limited thereto.

The polymerization method typically includes the following processes (1)-(5).

(1) At first, a resin, a prepolymer, a colorant (such as pigments), and other additives such as release agents, charge controlling agents and the like are dissolved or dispersed in a volatile organic solvent to prepare a toner constituent mixture liquid (i.e., an oil phase liquid). In order to decrease the viscosity of the oil phase liquid, i.e., in order to easily perform emulsification, volatile solvents which can dissolve the resin and prepolymer used are preferably used. The volatile solvents preferably have a boiling point lower than 100° C. so as to be easily removed after the granulating process.

Specific examples of the volatile solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination. In particular, aromatic solvents such as toluene and xylene, and halogenated hydrocarbons such as methylene chloride, 1,2-dichloroethane, chloroform and carbon tetrachloride are preferably used.

The added amount of the organic solvent is generally from 0 to 300 parts, preferably from 0 to 100 parts and more preferably from 25 to 70 parts by weight, per 100 parts by weight of the prepolymer (A). When a solvent is used, the solvent is removed after the extension and/or crosslinking reaction of the prepolymer under normal pressure or a reduced pressure.

(2) The thus prepared oil phase liquid is dispersed in an aqueous medium using the below-mentioned dispersing method.

Suitable aqueous media include water. In addition, other solvents which can be mixed with water can be added to water. Specific examples of such solvents include alcohols such as methanol, isopropanol, and ethylene glycol; dimethylformamide, tetrahydrofuran, cellosolves such as methyl cellosolve, lower ketones such as acetone and methyl ethyl ketone, etc.

In the dispersing process, the weight ratio of the toner constituent mixture liquid (i.e., the oil phase liquid) including a prepolymer and other toner constituents to the aqueous medium is generally from 100/50 to 100/2000, and preferably from 100/100 to 100/1000. When the amount of the aqueous medium is too small, the particulate organic material tends not to be well dispersed, and thereby a toner having a desired particle diameter cannot be prepared. In contrast, to use a large amount of aqueous medium is not economical.

The aqueous medium optionally includes a dispersant such as surfactants and particulate resins.

Specific examples of the surfactants include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di)octylaminoethyle)glycin, and N-alkyl-N,N-dimethylammonium betaine.

By using a fluorine-containing surfactant as the surfactant, good charging properties and good charge rising property can be imparted to the resultant toner.

Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl (C6-C11)oxy}-1-alkyl(C3-C4)sulfonate, sodium 3-{omega-fluoroalkanoyl(C6-C8)-N-ethylamino}-1-propanesulfonate, fluoroalkyl(C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl (C6-C10)-N-ethylsulfonyl glycin, monoperfluoroalkyl(C6-C16)ethylphosphates, etc.

Specific examples of the marketed products of such surfactants include SARFRON S-111, S-112 and S-113, which are manufactured by Asahi Glass Co., Ltd.; FLUORAD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of the cationic surfactants having a fluoroalkyl group, which can disperse an oil phase including toner constituents in water, include primary, secondary and tertiary aliphatic amines having a fluoroalkyl group, aliphatic quaternary ammonium salts such as perfluoroalkyl(C6-C10)sulfoneamidepropyltrimethylammonium salts, benzalkonium salts, benzetonium chloride, pyridinium salts, imidazolinium salts, etc. Specific examples of the marketed products thereof include SARFRON S-121 (from Asahi Glass Co., Ltd.); FLUORAD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

Suitable particulate resins for use in the toner include any known resins which can be dispersed in an aqueous medium. Specific examples of the resins include thermoplastic and thermosetting resins such as vinyl resins, polyurethane resins, epoxy resins, polyester resins, polyamide resins, polyimide resins, silicon-containing resins, phenolic resins, melamine resins, urea resins, aniline resins, ionomer resins, polycarbonate resins, etc. These resins can be used alone or in combination.

Among these resins, vinyl resins, polyurethane resins, epoxy resins, polyester resins and combinations thereof are preferably used because aqueous dispersions of the resins can be easily prepared. Suitable vinyl resins include homopolymers and copolymers of one or more vinyl monomers. Specific examples of the vinyl resins include styrene-(meth)acrylate copolymers, styrene-butadiene copolymers, (meth) acrylic acid-acrylate copolymers, styrene-acrylonitrile copolymers, styrene-maleic anhydride copolymers, styrene-(meth)acrylate copolymers, etc.

The average particle diameter of the particulate resins is from 5 to 300 nm and preferably from 20 to 200 nm.

In addition, inorganic dispersants which are hardly soluble in water, such as tricalcium phosphate, calcium carbonate, titanium oxide, colloidal silica, and hydroxyapatite can also be used.

Further, it is possible to stably disperse the toner constituent mixture liquid in an aqueous liquid using a polymeric protection colloid. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g., acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

The method for dispersing a toner composition liquid in an aqueous medium is not particularly limited, and known dispersing devices such as low shearing force type dispersing machines, high shearing force type dispersing machines, friction type dispersing machines, high pressure jet type dispersing machines and ultrasonic dispersing machine can be used. In order to prepare a dispersion including particles having an average particle diameter of from 2 to 20 μm, high shearing force type dispersing machines are preferably used.

When high shearing force type dispersing machines are used, the rotation speed of rotors is not particularly limited, but the rotation speed is generally from 1,000 to 30,000 rpm and preferably from 5,000 to 20,000 rpm. In addition, the dispersing time is also not particularly limited, but the dispersing time is generally from 0.1 to 5 minutes for batch dispersing machines. The temperature in the dispersing process is generally 0 to 150° C. (under pressure), and preferably from 40 to 98° C.

(3) At the same time when the emulsion is prepared, an amine (B) is added to the emulsion to be reacted with the polyester prepolymer (A) having an isocyanate group.

This reaction is accompanied with a crosslinking reaction and/or a polymer chain growth reaction. The reaction time, which is determined depending on the reactivity of the isocyanate group of the polyester prepolymer (A) with the amine used, is generally from 10 minutes to 40 hours, and preferably from 2 to 24 hours. The reaction temperature is generally from 0 to 150° C. and preferably from 40 to 98° C. If necessary, known catalysts such as dibutyltin laurate and dioctyltin laurate can be used for the reaction.

(4) After the reaction, the organic solvent included in the emulsion are removed, and then the resultant particles are washed and dried. Thus, toner particles are prepared.

When removing an organic solvent in the emulsion, a method in which the emulsion is heated while strongly agitated so as to have a laminar flow is preferably used. In this case, the resultant toner particles have a spindle form.

When a dispersion stabilizer such as calcium phosphate which can be dissolved in an acid or an alkali is used, the particles are preferably washed after the polymer chain growth reaction and/or crosslinking reaction by a method in which the particles are washed with an acid such as hydrochloric acid to dissolve the dispersant, and then washed with water. In addition, such dispersants can also be removed from the resultant particles by a method using an enzyme.

(5) Next, a charge controlling agent is fixed to the thus prepared toner particles and then a particulate inorganic material (such as silica and titania) serving as an external additive is added thereto. Thus, a toner is prepared by a polymerization method.

This external additive addition operation is performed by any known methods using a mixer.

By using this toner manufacturing method, a toner having a sharp particle diameter distribution can be easily prepared. In addition, by changing the shearing force applied to the emulsion in the organic solvent removing process, the shape of the resultant toner particles can be easily changed from a true circular form to a form like a rugby ball and in addition, the surface conditions of the resultant toner particles can also be changed for a smooth surface to a wrinkled surface.

The developing device of the present invention uses the toner mentioned above as a one-component non-magnetic developer. The toner can also be used as a one-component magnetic developer if a magnetic material is included in the toner.

The thus prepared toner is preferably used for a color developer because the color toner can produce images having good fine line (dot) reproducibility, less granularity, and good half tone color reproducibility.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

At first, cartridges used for the following examples and comparative examples will be explained.

(Cartridge C1)

Figure 13:
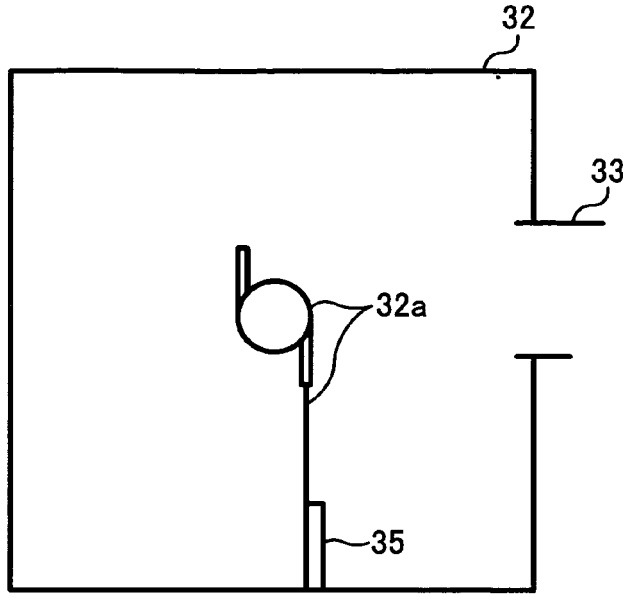
FIGS. 13 and 14 are schematic views illustrating the cartridges C1 and C2 used for Examples 1-9 and Comparative Examples 1-5.

The cartridge C1 is a cartridge 32 having a structure as illustrated in FIG. 13. Specifically, the cartridge has a toner feeding paddle 32*a* and a rib 35 (i.e., a plate) which is provided on an inner surface of the cartridge 32 and which promotes to return the toner to the cartridge 32 from the hopper by forming a space near the openings 33 together with the toner feeding paddle 32*a*.

(Cartridge C2)

Figure 14:
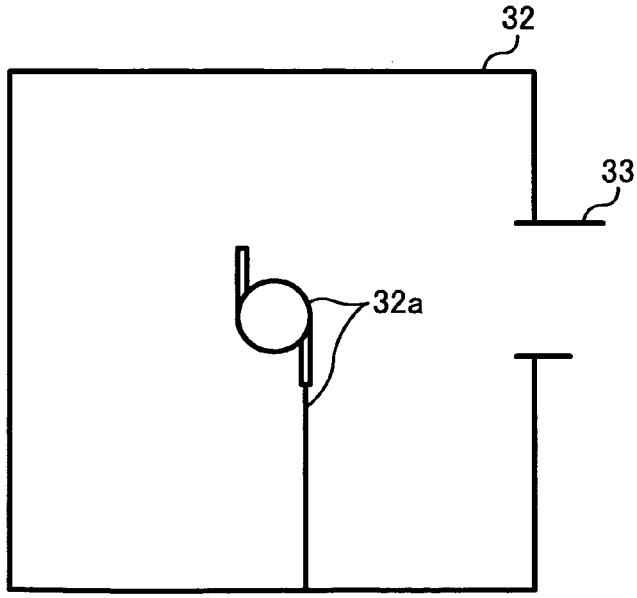

The cartridge C2 is a cartridge 32 having a structure as illustrated in FIG. 14. Specifically, the cartridge has only the toner feeding paddle 32*a* and has no rib.

Synthesis Example 1

Synthesis of Polyester Resin (a)

In a four-necked separable flask equipped with a stirrer, a thermometer, a nitrogen gas feed pipe, a condenser and a cooling tube, the following components were mixed.

| | |
|---|---|
| Polyoxypropylene(2.2)-2,2-bis(4-hydroxyphenyl)propane | 740 g |
| Polyoxyethylene(2.2)-2,2-bis(4-hydroxyphenyl)propane | 300 g |
| Dimethyl terephthalate | 466 g |
| Isododecenysuccinic anhydride | 80 g |
| Tri-n-butyl 1,2,4-benzenetricarboxylate | 114 g |

In addition, an esterification catalyst was also added thereto.

The mixture was reacted for 8 hours at 210° C. under a nitrogen gas flow. In addition, the mixture was further reacted for 5 hours at 210° C. under a reduced pressure.

Thus, a polyester resin (a) having a glass transition temperature (Tg) of 62° C. and a Mw/Mn ratio of 5.1 was prepared.

Synthesis Example 2

Synthesis of Polyester Resin (b)

The procedure for preparation of the polyester resin (a) was repeated except that the following components were used and the reaction times for the first and second reactions were shortened.

| | |
|---|---|
| Polyoxypropylene(2.2)-2,2-bis(4-hydroxyphenyl)propane | 650 g |
| Polyoxyethylene(2.2)-2,2-bis(4-hydroxyphenyl)propane | 650 g |
| Isophthalic acid | 515 g |
| Isooctenysuccinic anhydride | 70 g |
| 1,2,4-benzenetricarboxylic acid | 80 g |

In addition, an esterification catalyst was also added thereto.

Thus, a polyester resin (b) having a glass transition temperature (Tg) of 61° C. and a Mw/Mn ratio of 2.7 was prepared.

Synthesis Example 3

Synthesis of Polyester Resin (c)

The procedure for preparation of the polyester resin (b) was repeated except that the reaction times for the first and second reactions were the same as those in Synthesis Example 1.

Thus, a polyester resin (c) having a glass transition temperature (Tg) of 67° C. and a Mw/Mn ratio of 4.6 was prepared.

Toner Preparation Example 1

Preparation of Toner Particles A

The following components were mixed with a HENSCHEL MIXER (trademark) mixer (from Mitsui Miike Machinery Co., Ltd.).

| | |
|---|---|
| Toner particles A | 100 parts |
| Hydrophobized silica (H2000 from Clariant Japan K.K., having a BET specific surface area of 120 $m^2/g$) | 1.8 parts |
| Hydrophobized silica (RX-50 from Nippon Aerosil Co., having a BET specific surface area of 50 $m^2/g$) | 1.2 parts |

The mixture was then kneaded for 30 minutes using a two-roll mill in which the temperature of surface of the rollers are controlled to be 100° C. The kneaded mixture was then subjected to roll cooling, followed by crushing, pulverization using a jet air type pulverizer (I-2 type mill from Nippon Pneumatic Mfg. Co., Ltd.) and air classification using a DS classifier (from Nippon Pneumatic Mfg. Co., Ltd.) which performs air classification by swirling air.

Thus, black toner particles A having a weight average particle diameter of 7.0 μm were prepared.

Preparation of Toner T1

The following components were mixed with a HENSCHEL MIXER (TRADEMARK) mixer.

| | |
|---|---|
| Polyester (a) (binder resin) | 100 parts |
| Carbon black (colorant) | 5 parts |
| Charge controlling agent (BONTRON E-84 from Orient Chemical Industries Co., Ltd.) | 2 parts |

Thus, a toner T1, which has a weight average particle diameter of 7.0 μm, a powder wall collapsing angle of 50°, an aggregation rate of 12% and a bulk density of 0.42 $g/cm^3$, was prepared.

Toner Preparation Examples 2-8

Preparation of Toner Particles B-D

The procedure for preparation of the toner particles A was repeated except that the formula of the toner particles was changed as described in Table 1.

TABLE 1

| | Polyester resin | | Charge controlling agent | | Weight |
|---|---|---|---|---|---|
| Toner particles | Polyester | Added amount (parts by weight) | BONTRON | Added amount (parts by weight) | average particle diameter (μm) |
| A | (a) | 100 | E-84 | 2.0 | 7.0 |
| B | (a) | 100 | E-84 | 3.0 | 6.8 |
| C | (b) | 100 | E-84 | 1.5 | 7.3 |
| D | (c) | 100 | X-11 | 2.0 | 6.5 |

Note:
BONTRON E-84 (zinc salicylate) and BONTRON X-11 (iron salicylate) are charge controlling agents manufactured by Orient Chemical Industries Co., Ltd.

Preparation of Toners T2-T8

The procedure for preparation of the toner T1 was repeated except that the formula of the toner was changed as described in Table 2.

Thus, toners T2-T8 were prepared. The properties of the toners are shown in Table 3.

TABLE 2

| | Toner particles | | External additive 1 | | External additive 2 | |
|---|---|---|---|---|---|---|
| Toner | Toner particles | Added amount (parts by weight) | Additive | Added amount (parts by weight) | Additive | Added amount (parts by weight) |
| T1 | A | 100 | H-2000 | 1.8 | RX-50 | 1.2 |
| T2 | A | 100 | H-2000 | 1.2 | RX-50 | 0.5 |
| T3 | B | 100 | H-2000 | 1.5 | RX-50 | 1.0 |
| T4 | B | 100 | H-3004 | 1.2 | RX-50 | 1.8 |
| T5 | C | 100 | H-3004 | 1.6 | RX-50 | 0.5 |
| T6 | B | 100 | H-2000 | 0.8 | None | — |
| T7 | C | 100 | H-2000 | 2.4 | H-3004 | 0.8 |
| T8 | D | 100 | H-2000 | 2.8 | RX-50 | 1.0 |

Note:
The details of the external additives are as follows.
H-2000: Silica from Clariant Japan K.K., which has a BET specific surface area of 120 $m^2/g$.
H-3004: Silica from Clariant Japan K.K., which has a BET specific surface area of 200 $m^2/g$.
RX-50: Silica from Nippon Aerosil Co., which has a BET specific surface area of 50 $m^2/g$.

TABLE 3

| Toner | Weight average particle diameter (μm) | Powder wall collapsing angle (°) | Bulk density (g/cm$^3$) | Aggregation rate (%) |
|---|---|---|---|---|
| T1 | 7.0 | 50 | 0.42 | 12 |
| T2 | 7.1 | 70 | 0.45 | 15 |
| T3 | 6.8 | 60 | 0.44 | 14 |
| T4 | 6.9 | 30 | 0.36 | 6 |
| T5 | 7.3 | 45 | 0.38 | 11 |
| T6 | 6.8 | 80 | 0.53 | 18 |
| T7 | 7.4 | 25 | 0.33 | 5 |
| T8 | 6.5 | 15 | 0.30 | 4 |

Toner Preparation Example 9

Preparation of Particulate Inorganic Material

At first, a liquefied $SiCl_4$ was fed into a burner at a flow rate of 250 SCCM (standard cubic centimeter per minute) using a liquid feeding device together with an Ar gas serving as a carrier gas which was fed at a flow rate of 300 SCCM, a hydrogen ($H_2$) gas which was fed at a flow rate of 20 SLM (standard liter per minute) and an oxygen ($O_2$) gas which was fed at a flow rate of 20 SLM (standard liter per minute) to perform a flame hydrolysis/fusion treatment. Thus, a particulate silica was prepared. The particulate silica was subjected to a particle diameter growth treatment so as to have a predetermined particle diameter. The resultant particulate silica was subjected to a hydrophobizing treatment using hexamethyldisilazane.

Thus, a particulate inorganic material (1) having a primary particle diameter of 5 nm was prepared.

Preparation of Resin Dispersion

In a reaction vessel equipped with a stirrer and a thermometer, 683 parts of water, 11 parts of a sodium salt of sulfate of an ethylene oxide adduct of methacrylic acid (ELEMINOL RS-30 from Sanyo Chemical Industries Ltd.), 80 parts of styrene, 83 parts of methacrylic acid, 110 parts of butyl acrylate, 12 parts of butyl thioglycolate and 1 part of ammonium persulfate were mixed. The mixture was agitated for 15 minutes while the stirrer was rotated at a revolution of 400 rpm. As a result, a milky emulsion was prepared. Then the emulsion was heated to 75° C. to react the monomers for 5 hours.

Further, 30 parts of a 1% aqueous solution of ammonium persulfate was added thereto, and the mixture was aged for 5 hours at 75° C. Thus, an aqueous dispersion of a vinyl resin (i.e., a copolymer of styrene/methacrylic acid/butyl acrylate/butyl thioglycolate/sodium salt of sulfate of ethylene oxide adduct of methacrylic acid, hereinafter referred to as particulate resin dispersion (1)) was prepared.

The volume average particle diameter of the particles in the particulate resin dispersion (1), which was measured with an instrument LA-920 from Horiba Ltd., was 120 nm. In addition, part of the particulate resin dispersion (1) was dried to prepare a solid of the vinyl resin. It was confirmed that the vinyl resin has a glass transition temperature of 42° C. and a weight average molecular weight of 30,000.

Preparation of Aqueous Phase Liquid

In a reaction vessel equipped with a stirrer, 990 parts of water, 65 parts of the particulate resin dispersion (1) prepared above, 37 parts of an aqueous solution of a sodium salt of dodecyldiphenyletherdisulfonic acid (ELEMINOL MON-7 from Sanyo Chemical Industries Ltd., solid content of 48.5%), and 90 parts of ethyl acetate were mixed while agitated. As a result, a milky liquid (hereinafter referred to as an aqueous phase liquid (1)) was prepared.

Preparation of Low Molecular Weight Polyester Resin

The following components were contained in a reaction vessel equipped with a condenser, a stirrer and a nitrogen feed pipe and the mixture was subjected to a polycondensation reaction for 8 hours at 230° C. under a normal pressure.

| | |
|---|---|
| Ethylene oxide (2 mole) adduct of bisphenol A | 229 parts |
| Propylene oxide (3 mole) adduct of bisphenol A | 529 parts |
| Terephthalic acid | 208 parts |
| Adipic acid | 46 parts |
| Dibutyltin oxide | 2 parts |

Then the reaction was further continued for 5 hours under a reduced pressure of from 10 to 15 mmHg.

Further, 44 parts of trimellitic anhydride were fed to the container to be reacted with the reaction product for 2 hours at 180° C. under a normal pressure. Thus, a low molecular weight polyester resin (1) was prepared. The low molecular weight polyester resin (1) has a number average molecular weight of 2500, a weight average molecular weight of 6700, a glass transition temperature (Tg) of 43° C. and an acid value of 25 mgKOH/g.

Preparation of Polyester Prepolymer

The following components were contained in a reaction vessel equipped with a condenser, a stirrer and a nitrogen feed pipe and reacted for 8 hours at 230° C. under a normal pressure.

| | |
|---|---|
| Ethylene oxide (2 mole) adduct of bisphenol A | 682 parts |
| Propylene oxide (2 mole) adduct of bisphenol A | 81 parts |
| Terephthalic acid | 283 parts |
| Trimellitic anhydride | 22 parts |
| Dibutyl tin oxide | 2 parts |

Then the reaction was further continued for 5 hours under a reduced pressure of from 10 to 15 mmHg. Thus, an intermediate polyester resin (1) was prepared. The intermediate polyester (1) has a number average molecular weight of 2100, a weight average molecular weight of 9500, a glass transition temperature (Tg) of 55° C., an acid value of 0.5 mgKOH/g and a hydroxyl value of 51 mgKOH/g.

In a reaction vessel equipped with a condenser, a stirrer and a nitrogen feed pipe, 410 parts of the intermediate polyester resin (1), 125 parts of isophorone diisocyanate and 500 parts of ethyl acetate were mixed and the mixture was heated at 100° C. for 2 hours to perform the reaction. Thus, a polyester prepolymer (1) having an isocyanate group was prepared. The number of isocyanate groups included in one molecule of the polyester prepolymer (1) was 2.15 on average.

Synthesis of Ketimine Compound

In a reaction vessel equipped with a stirrer and a thermometer, 170 parts of isophorone diamine and 75 parts of methyl ethyl ketone were mixed and reacted for 5 hours at 50° C. to prepare a ketimine compound (1). The ketimine compound (1) has an amine value of 418 mgKOH/g.

Preparation of Master Batch

The following components were mixed.

| | |
|---|---|
| Water | 1200 parts |
| Carbon black (REGAL 400R from Cabot Corp.) | 40 parts |
| Polyester resin (RS801 from Sanyo Chemical Industries, Ltd.) | 60 parts |

Thirty (30) parts of water was further added thereto and the mixture was mixed using a HENSCHEL MIXER (trademark) mixer from Mitsui Mining Co., Ltd. The mixture was then kneaded for 30 minutes at 150° C. using a two roll mill. The kneaded mixture was cooled by rolling, followed by pulverization. Thus, a master batch (1) was prepared.

Preparation of Oil Phase Liquid

In a reaction vessel equipped with a stirrer and a thermometer, 400 parts of the low molecular weight polyester resin (1), 110 parts of carnauba wax, and 947 parts of ethyl acetate were mixed and the mixture was heated to 80° C. while agitated. After the mixture was heated at 80° C. for 5 hours, the mixture was cooled to 30° C. over 1 hour. Then 500 parts of the master batch (1) and 500 parts of ethyl acetate were added to the vessel, and the mixture was agitated for 1 hour to prepare a raw material dispersion (1).

Then 1324 parts of the raw material dispersion (1) was subjected to a dispersion treatment using a bead mill (ULTRAVISCOMILL from Aimex Co., Ltd.). The dispersing conditions were as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Then 1324 parts of 65% ethyl acetate solution of the low molecular weight polyester resin (1) prepared above and the particulate inorganic material (1) were added thereto. The mixture was subjected to the dispersion treatment using the bead mill. The dispersion conditions are the same as those mentioned above except that the dispersion operation was performed once (i.e., one pass).

The thus prepared pigment/wax dispersion (1) had a solid content of 50% when it was determined by heating the liquid at 130° C. for 30 minutes.

Emulsification

Then the following components were fed in a vessel.

| | |
|---|---|
| Pigment/wax dispersion (1) prepared above | 648 parts |
| Prepolymer (1) prepared above | 154 parts |
| Ketimine compound (1) prepared above | 8.5 parts |

The components were mixed for 1 minute using a TK HOMOMIXER (trademark) mixer from Tokushu Kika Kogyo K.K. at a revolution of 5,000 rpm. Thus, an oil phase liquid (1) (i.e., a toner composition liquid) was prepared.

Then 1,200 parts of the aqueous phase liquid (1) was added thereto and the mixture was mixed for 20 minutes using the TK HOMOMIXER mixer at a revolution of 13,000 rpm. Thus, an emulsion (1) was prepared. In this case, a polymer chain growth reaction was made.

Solvent Removal

The emulsion (1) was fed into a container equipped with a stirrer having paddles and a thermometer, and the emulsion was heated for 8 hours at 30° C. to remove the organic solvent (ethyl acetate) from the emulsion. Then the emulsion was aged for 4 minutes at 45° C. Thus, a dispersion (1) was prepared.

Washing and Drying

One hundred (100) parts of the dispersion (1) was filtered under a reduced pressure.

Then the wet cake was mixed with 100 parts of ion-exchange water and the mixture was agitated for 10 minutes with a TK HOMOMIXER (TRADEMARK) mixer at a revolution of 12,000 rpm, followed by filtration. Thus, a wet cake (a) was prepared.

The thus prepared wet cake (a) was mixed with 100 parts of a 10% sodium hydroxide and the mixture was agitated for 30 minutes with the TK HOMOMIXER (TRADEMARK) mixer at a revolution of 12,000 rpm, followed by filtration. Thus, a wet cake (b) was prepared.

The thus prepared wet cake (b) was mixed with 100 parts of a 10% hydrochloric acid and the mixture was agitated for 10 minutes with the TK HOMOMIXER (TRADEMARK) mixer at a revolution of 12,000 rpm, followed by filtration. Thus, a wet cake (c) was prepared.

Then the wet cake (c) was mixed with 300 parts of ion-exchange water and the mixture was agitated for 10 minutes with the TK HOMOMIXER (TRADEMARK) mixer at a revolution of 12,000 rpm, followed by filtration. This operation was repeated twice. Thus, a wet cake (1) was prepared.

The wet cake (1) was dried for 48 hours at 45° C. using a circulation air drier, followed by screening with a sieve having openings of 75 μm.

Thus, toner particles (E) having a weight average particle diameter of 6.5 μm were prepared.

Addition of External Additive

One hundred (100) parts of the toner particles (E) and 1.5 parts of a charge controlling agent (BONTRON E-84 from Orient Chemical Industries Co., Ltd.) were mixed using a Q-form mixer from Mitsui Mining Co., Ltd. The mixing conditions were as follows.

Peripheral speed of turbine blade: 50 m/s

Mixing operation: Cycle of mixing for 2 minutes, followed by pause for 1 minute was repeated five times (mixing time was 10 minutes in total).

In addition, 1.8 parts of a silica (H-2000 from Clariant Japan K.K.) and 1.2 parts of a silica (RX-50 from Nippon Aerosil Co.) were added thereto, and the mixture was mixed using the Q-form mixer. The mixing conditions were as follows.

Peripheral speed of turbine blade: 15 m/s

Mixing operation: Cycle of mixing for 30 seconds, followed by pause for 1 minute was repeated five times (mixing time was 2.5 minutes in total).

Thus, a toner T9 was prepared. The properties of the toner T9 are shown in Table 5.

Toner Preparation Examples 10-14

Preparation of Toner Particles F-H

The procedure for preparation of the toner particles (E) was repeated except that the rotation number of the TK HOMOMIXER mixer and mixing time in the emulsification process, and temperature and solvent removing time in the solvent removal process were changed to change the particle diameter of the mother toner particles.

Preparation of Toners T10-T14

The procedure for preparation of the toner T9 was repeated except that the toner particles and the external additives were changed as shown in Table 4.

Thus, toners T10-T14 were prepared. The properties of the toners T10-T14 are also shown in Table 5.

TABLE 4

| | Toner particles | | External additive 1 | | External additive 2 | |
|---|---|---|---|---|---|---|
| Toner | Toner particles | Added amount (parts by weight) | Additive | Added amount (parts by weight) | Additive | Added amount (parts by weight) |
| T9 | E | 100 | H-2000 | 1.8 | RX-50 | 1.2 |
| T10 | F | 100 | H-2000 | 2.0 | RX-50 | 0.7 |
| T11 | G | 100 | H-2000 | 1.4 | RX-50 | 0.5 |
| T12 | H | 100 | H-3004 | 1.0 | RX-50 | 0.8 |
| T13 | F | 100 | H-2000 | 3.0 | RX-50 | 1.2 |
| T14 | H | 100 | H-2000 | 0.8 | H-3004 | 0.4 |

TABLE 5

| Toner | Weight average particle diameter (μm) | Powder wall collapsing angle (°) | Bulk density (g/cm$^3$) | Aggregation rate (%) |
|---|---|---|---|---|
| T9 | 6.5 | 55 | 0.40 | 13 |
| T10 | 6.7 | 60 | 0.43 | 14 |
| T11 | 7.1 | 40 | 0.38 | 10 |
| T12 | 6.9 | 35 | 0.36 | 9 |
| T13 | 6.3 | 15 | 0.31 | 4 |
| T14 | 7.4 | 75 | 0.52 | 17 |

Example 1

The toner T1 was set in the cartridge C1, and the cartridge C1 was set in an image forming apparatus (IMAGIO NEO C320 from Ricoh Co., Ltd.) to produce images. The evaluation methods are mentioned below. The evaluation results are shown in Table 6.

Examples 2-9

The procedure for evaluation of the toner T1 in Example 1 was repeated except that the toner was replaced with each of the toners T2-T5 and T9-T12. The evaluation methods are mentioned below. The evaluation results are shown in Table 6.

Comparative Examples 1-5

The procedure for evaluation of the toner T1 in Example 1 was repeated except that the toner was replaced with each of the toners T6-T8, T13 and T14. The evaluation methods are mentioned below. The evaluation results are shown in Table 6.

Method for Evaluating Images

A running test in which 100,000 copies of a black and white original image with an image area proportion of 3% are continuously produced while the toner is replenished six times was performed. The running test was preformed in a single color mode (i.e., black and white mode). Then the following evaluation was performed.

(1) Background Density (BD)

After the running test, a white solid image was formed. In the middle of the developing operation, the power of the image forming apparatus was suddenly turned off. An adhesive tape was adhered to a developed portion of the photoreceptor to transfer the toner particles on the photoreceptor to the adhesive tape. The density of each of the adhesive tape having the toner particles thereon and the blank adhesive tape was measured with a spectrodensitometer (X-Rite 938 from X-Rite Inc.) to determine the difference between the densities (i.e., the background density). The density measurements are performed with respect to three points of the adhesive tape to obtain an average density.

(2) White Streak (WS) and Toner Layer Formability on Developing Roller

At the beginning of the running test and after the running test, the toner layer formed on the developer bearing member was observed to determine whether a uniform thin toner layer is formed thereon. In addition, the produced images were visually observed to determine whether the black solid image has white streaks.

The quality was classified into the following three grades.

○: A uniform thin toner layer is formed and the images have no white streaks.

Δ: The toner layer has several white streaks with a width of less than 0.3 mm, but white streaks are hardly observed in the resultant black solid images.

X: The toner layer has several white streaks with a width of not less than 0.3 mm, and clear white streaks can be observed in the resultant black solid images.

(3) Filming (Film)

After the running test, the surface of the developing roller and the photoreceptor is observed to determine whether a toner film is formed thereon.

The quality was classified into the following three grades.

○: A toner film is not formed thereon.

Δ: Streaks of toner film are formed thereon.

X: A toner film is formed on the entire surface of the developing roller and the photoreceptor.

The evaluation results are shown in Table 6.

TABLE 6

| | | | | At beginning of running test | | After running test | | | Over All |
|---|---|---|---|---|---|---|---|---|---|
| | Cartridge | Toner | PWCA* (°) | BD | WS | BD | WS | Film | Jud.*2 |
| Ex. 1 | C1 | T1 | 50 | 0.00 | ○ | 0.01 | ○ | ○ | ◎ |
| Ex. 2 | C1 | T2 | 70 | 0.00 | Δ | 0.01 | Δ | ○ | ○ |
| Ex. 3 | C1 | T3 | 60 | 0.00 | ○ | 0.01 | ○ | ○ | ○ |
| Ex. 4 | C1 | T4 | 30 | 0.00 | ○ | 0.04 | ○ | ○ | Δ |
| Ex. 5 | C1 | T5 | 45 | 0.01 | ○ | 0.03 | ○ | ○ | Δ |
| Ex. 6 | C1 | T9 | 55 | 0.00 | ○ | 0.02 | ○ | ○ | ○ |

TABLE 6-continued

| | Cartridge | Toner | PWCA* (°) | At beginning of running test BD | At beginning of running test WS | After running test BD | After running test WS | After running test Film | Over All Jud.*2 |
|---|---|---|---|---|---|---|---|---|---|
| Ex. 7 | C1 | T10 | 60 | 0.01 | ○ | 0.01 | ○ | ○ | ○ |
| Ex. 8 | C1 | T11 | 40 | 0.00 | ○ | 0.03 | ○ | ○ | Δ |
| Ex. 9 | C1 | T12 | 35 | 0.00 | ○ | 0.04 | ○ | ○ | Δ |
| Comp. Ex. 1 | C2 | T6 | 80 | 0.02 | Δ | 0.09 | X | Δ | X |
| Comp. Ex. 2 | C2 | T13 | 15 | 0.01 | ○ | 0.25 | ○ | Δ | X |
| Comp. Ex. 3 | C2 | T8 | 15 | 0.01 | ○ | 0.18 | Δ | ○ | X |
| Comp. Ex. 4 | C1 | T7 | 25 | 0.01 | ○ | 0.12 | ○ | Δ | Δ |
| Comp. Ex. 5 | C1 | T14 | 75 | 0.02 | Δ | 0.10 | X | Δ | X |

PWCA*: Powder wall collapsing angle
Over all Jud.*2: Over all judgment

It is clear from Table 6 that the process cartridges of Examples 1-9 can produce images without background fouling and white streaks and do not cause the filming problem even after long repeated use.

In contrast, the cartridges of Comparative Examples 1-3, which do not have the rib serving as a toner return promoter, cause the background fouling problem and at least one of the white streak problem and the filming problem after long repeated use although the cartridges do not cause the problems at the beginning of the running test.

In the cartridges of Comparative Example 4, which uses a toner having a powder wall collapsing angle of 25° which falls outside the preferable range of from 30 to 70°, the background density is slightly high and a streak of toner film is formed after long repeated use although the cartridges do not cause the problems at the beginning of the running test.

In the cartridges of Comparative Example 4, which uses a toner having a powder wall collapsing angle of 75° which falls outside the preferable range of from 30 to 70°, the white streak problem is caused after long repeated use although the cartridges do not cause the problems at the beginning of the running test.

Toner Preparation Examples 15-22

The procedure for preparation of the toner T1 in Toner Preparation Example 1 was repeated except that the formula of the toner is changed as described in Table 7. The properties of the toners T15-T22 are shown in Table 8.

TABLE 7

| Toner | Toner particles: Toner particles | Toner particles: Added amount (parts by weight) | External additive 1: Additive | External additive 1: Added amount (parts by weight) | External additive 2: Additive | External additive 2: Added amount (parts by weight) |
|---|---|---|---|---|---|---|
| T15 | A | 100 | H-2000 | 2.0 | RX-50 | 1.0 |
| T16 | B | 100 | H-3004 | 1.2 | RX-50 | 1.8 |
| T17 | C | 100 | H-3004 | 1.6 | RX-50 | 0.5 |
| T18 | D | 100 | H-2000 | 2.8 | RX-50 | 1.2 |
| T19 | C | 100 | H-2000 | 2.4 | H-3004 | 0.8 |
| T20 | A | 100 | H-2000 | 1.2 | RX-50 | 0.5 |
| T21 | B | 100 | H-2000 | 0.8 | None | — |
| T22 | B | 100 | H-2000 | 1.5 | RX-50 | 1.2 |

TABLE 8

| Toner | Weight average particle diameter (μm) | Powder wall collapsing angle (°) | Bulk density (g/cm$^3$) | Aggregation rate (%) |
|---|---|---|---|---|
| T15 | 7.0 | 35 | 0.36 | 9 |
| T16 | 6.9 | 30 | 0.35 | 6 |
| T17 | 7.3 | 45 | 0.38 | 10 |
| T18 | 6.5 | 10 | 0.31 | 4 |
| T19 | 7.4 | 25 | 0.34 | 6 |
| T20 | 7.1 | 70 | 0.46 | 15 |
| T21 | 6.8 | 80 | 0.53 | 18 |
| T22 | 6.8 | 55 | 0.41 | 11 |

Toner Preparation Examples 23-28

The procedure for preparation of the toner T9 in Toner Preparation Example 9 was repeated except that the formula of the toner is changed as described in Table 9. The properties of the toners T23-T28 are shown in Table 10.

TABLE 9

| Toner | Toner particles: Toner particles | Toner particles: Added amount (parts by weight) | External additive 1: Additive | External additive 1: Added amount (parts by weight) | External additive 2: Additive | External additive 2: Added amount (parts by weight) |
|---|---|---|---|---|---|---|
| T23 | E | 100 | H-2000 | 1.8 | RX-50 | 1.5 |
| T24 | F | 100 | H-2000 | 3.0 | RX-50 | 1.2 |
| T25 | G | 100 | H-2000 | 1.4 | RX-50 | 0.5 |
| T26 | H | 100 | H-3004 | 2.0 | RX-50 | 0.8 |
| T27 | F | 100 | H-2000 | 1.8 | RX-50 | 1.2 |
| T28 | H | 100 | H-2000 | 0.8 | None | — |

TABLE 10

| Toner | Weight average particle diameter (μm) | Powder wall collapsing angle (°) | Bulk density (g/cm$^3$) | Aggregation rate (%) |
|---|---|---|---|---|
| T23 | 6.5 | 50 | 0.39 | 11 |
| T24 | 6.3 | 15 | 0.33 | 6 |
| T25 | 7.1 | 40 | 0.37 | 10 |
| T26 | 6.9 | 35 | 0.36 | 9 |
| T27 | 6.6 | 55 | 0.41 | 11 |
| T28 | 7.4 | 75 | 0.50 | 17 |

Examples 10-20

The procedure for evaluation of the toner T1 in Example 1 was repeated except that the developing device was replaced with one of the below-mentioned developing devices S1 and S2 and the toner was replaced with one of the toners T15-T19, and T23-T26. The evaluation methods are mentioned below. The evaluation results are shown in Table 11.

Comparative Examples 6-15

The procedure for evaluation of the toner T1 in Example 1 was repeated except that the developing device was replaced with one of the below-mentioned developing devices S1, S2 and S3, and the toner was replaced with one of the toners T15, T17-T22, T27 and T28. The evaluation methods are mentioned below. The evaluation results are shown in Table 11.

The developing devices S1, S2 and S3 are as follows.

Developing Device S1

Figure 15:
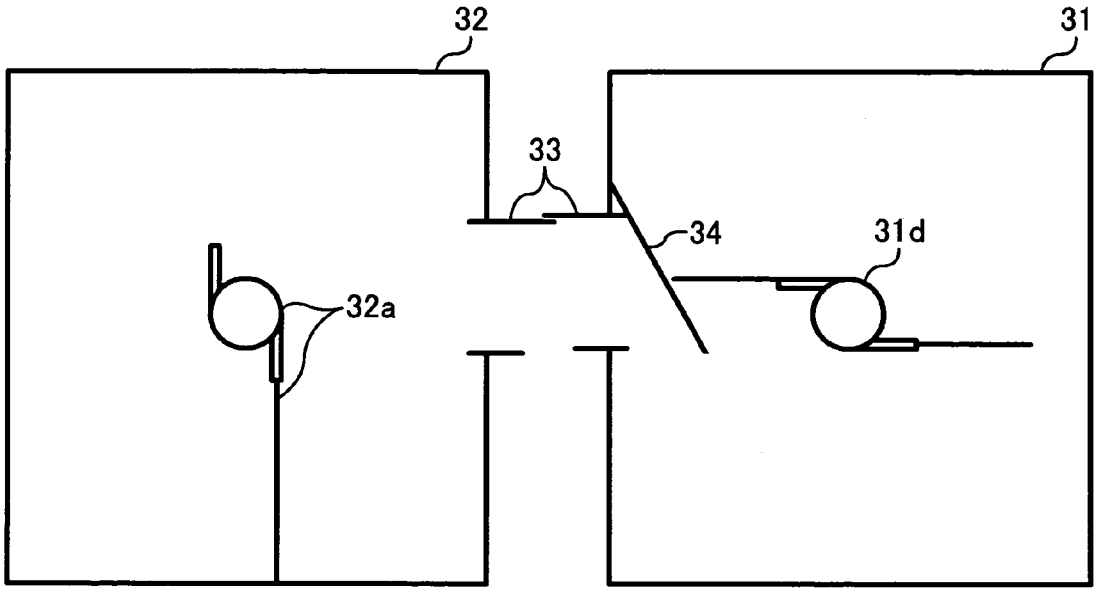
FIGS. 15-17 are schematic views illustrating the developing devices S1-S3 used for Examples 10-20 and Comparative Examples 6-15.

The developing device S1 has a structure as illustrated in FIG. 15, and includes a developing unit 31 including a rotating member 31*d* configured to agitate and transport the toner therein, and the control valve 34 which can be bent by being contacted with the rotating member 31*d* and then returned when the rotating member 31*d* is released therefrom, resulting in acceleration of transportation of the toner to the hopper from the toner cartridge. In addition, the developing unit includes the toner cartridge 32 having the rotating member 32*a* configured to agitate and transport the toner therein.

Developing Device S2

Figure 16:
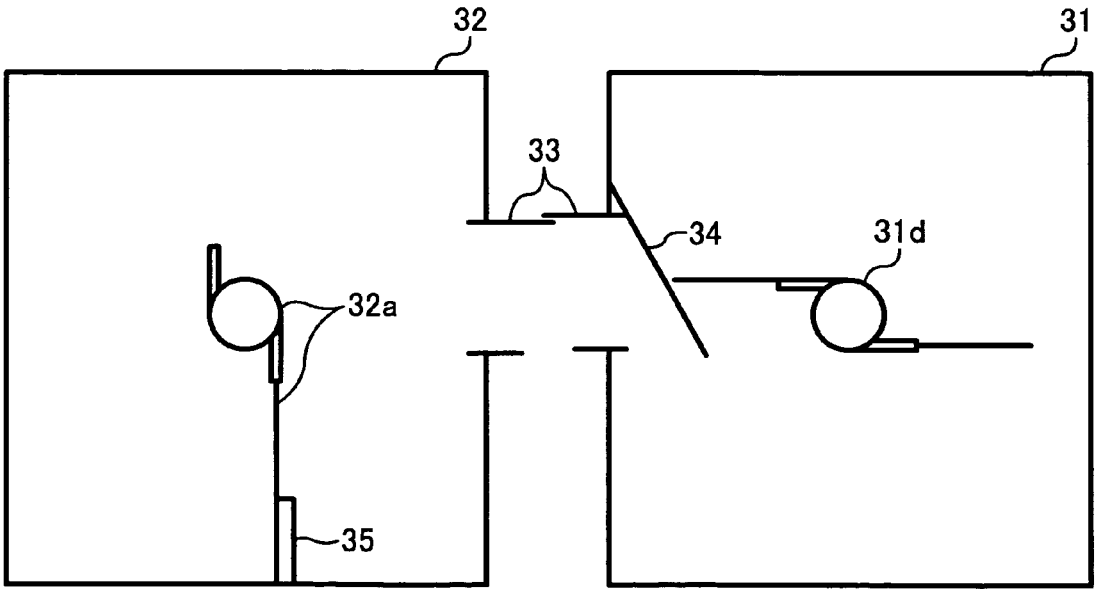

The developing device S2 has a structure as illustrated in FIG. 16. Specifically, the developing device S2 has a structure similar to that of the developing device S1 except that a plate (i.e., the rib) 35 is formed at a point of the inner wall of the cartridge. The rib serves as a toner return promoter as mentioned above.

Developing Device S3

Figure 17:
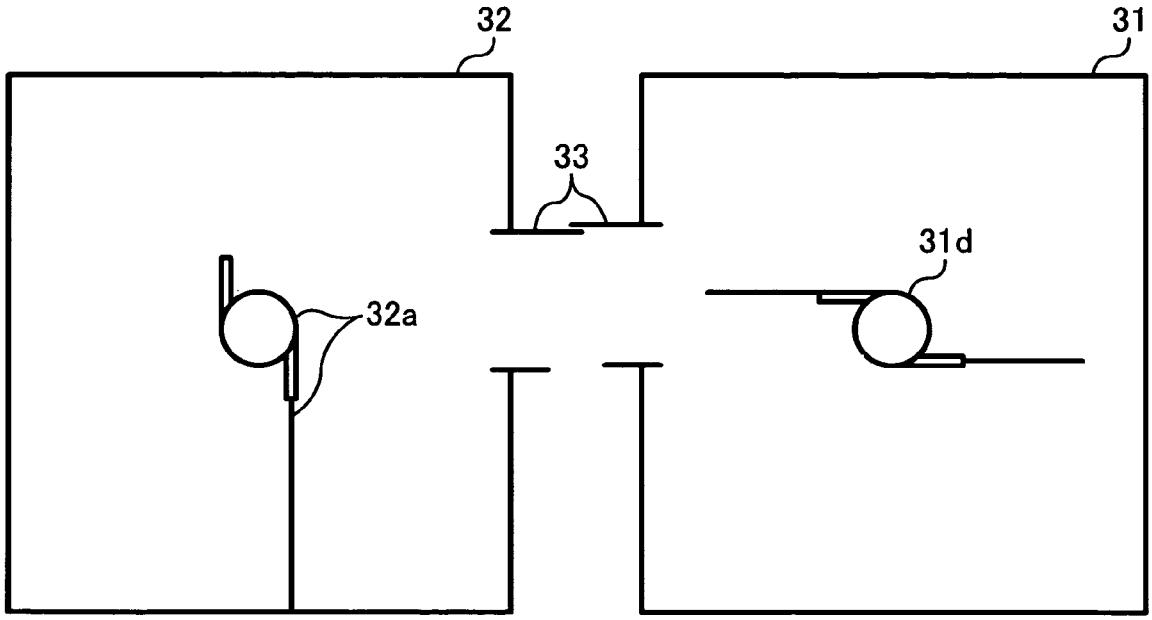

The developing device S3 has a structure as illustrated in FIG. 17. Specifically, the developing device S3 has a structure similar to that of the developing device S1 except that the valve 34 are not provided.

TABLE 11

| | Developing | | | At beginning of running test | | After running test | | | Over All |
|---|---|---|---|---|---|---|---|---|---|
| | Device | Toner | PWCA* (°) | BD | WS | BD | WS | Film | Jud.*2 |
| Ex. 10 | S1 | T15 | 35 | 0.00 | ○ | 0.03 | ○ | ○ | ○ |
| Ex. 11 | S1 | T17 | 45 | 0.00 | ○ | 0.03 | ○ | ○ | ○ |
| Ex. 12 | S1 | T18 | 10 | 0.01 | ○ | 0.05 | ○ | ○ | Δ |
| Ex. 13 | S1 | T23 | 15 | 0.00 | ○ | 0.04 | ○ | ○ | Δ |
| Ex. 14 | S1 | T24 | 50 | 0.01 | ○ | 0.03 | Δ | ○ | ○ |
| Ex. 15 | S2 | T16 | 30 | 0.00 | ○ | 0.02 | ○ | ○ | ◎ |
| Ex. 16 | S2 | T17 | 45 | 0.01 | ○ | 0.00 | ○ | ○ | ◎ |
| Ex. 17 | S2 | T18 | 10 | 0.00 | ○ | 0.05 | ○ | ○ | Δ |
| Ex. 18 | S2 | T19 | 25 | 0.00 | ○ | 0.03 | ○ | ○ | ○ |
| Ex. 19 | S2 | T25 | 40 | 0.00 | ○ | 0.00 | ○ | ○ | ◎ |
| Ex. 20 | S2 | T26 | 35 | 0.00 | ○ | 0.01 | ○ | ○ | ◎ |
| Comp. Ex. 6 | S3 | T15 | 35 | 0.00 | ○ | 0.09 | Δ | ○ | X |
| Comp. Ex. 7 | S3 | T17 | 45 | 0.00 | ○ | 0.07 | ○ | ○ | X |
| Comp. Ex. 8 | S3 | T18 | 10 | 0.02 | ○ | 0.25 | Δ | Δ | X |
| Comp. Ex. 9 | S3 | T19 | 25 | 0.01 | ○ | 0.15 | Δ | Δ | X |
| Comp. Ex. 10 | S3 | T22 | 55 | 0.00 | ○ | 0.08 | Δ | ○ | X |
| Comp. Ex. 11 | S3 | T28 | 75 | 0.01 | Δ | 0.13 | X | Δ | X |
| Comp. Ex. 12 | S1 | T20 | 70 | 0.02 | ○ | 0.09 | Δ | Δ | Δ |
| Comp. Ex. 13 | S1 | T27 | 55 | 0.01 | ○ | 0.07 | Δ | ○ | Δ |
| Comp. Ex. 14 | S2 | T21 | 80 | 0.00 | Δ | 0.06 | X | Δ | X |
| Comp. Ex. 15 | S2 | T22 | 55 | 0.00 | ○ | 0.05 | Δ | ○ | Δ |

PWCA*: Powder wall collapsing angle

Over all Jud.*2: Over all judgment

It is clear from Table 11 that the developing devices of Examples 10-20 can produce images without background fouling and white streaks and do not cause the filming problem even after long repeated use. Particularly, the developing devices of Examples 15, 16, 19 and 20 provide excellent performance.

In contrast, the developing devices of Comparative Examples 6-11, which do not have the rib and the valve, cause the background fouling problem and at least one of the white streak problem and the filming problem after long repeated use although the developing devices do not cause the problems at the beginning of the running test.

In the cartridges of Comparative Examples 12 and 13, which use a toner having a powder wall collapsing angle of 55° or 70° which falls outside the preferable range of from 5 to 50° and in which the developing device has no rib, the background density is slightly high and a weak white streak is formed on the developing sleeve after long repeated use although the cartridges do not cause the problems at the beginning of the running test.

In the cartridges of Comparative Example 15, which use a toner having a powder wall collapsing angle of 55°, a weak white streak is formed on the toner layer on the developing sleeve after long repeated use although the cartridges do not cause the problems at the beginning of the running test.

In the cartridges of Comparative Example 14, which use a toner having a powder wall collapsing angle of 80°, the white streak problem is caused.

Synthesis Example 4

Synthesis of Polyester Resin (d)

In a four-necked separable flask equipped with a stirrer, a thermometer, a nitrogen gas feed pipe, a condenser and a cooling tube, the following components were mixed.

| | |
|---|---|
| Polyoxypropylene(2.2)-2,2-bis(4-hydroxyphenyl)propane | 740 g |
| Polyoxyethylene(2.2)-2,2-bis(4-hydroxyphenyl)propane | 300 g |
| Dimethyl terephthalate | 466 g |
| Isododecenysuccinic anhydride | 80 g |
| Tri-n-butyl 1,2,4-benzenetricarboxylate | 114 g |

In addition, an esterification catalyst was also added thereto.

The mixture was reacted for 8 hours at 210° C. under a nitrogen gas flow. In addition, the mixture was further reacted for 5 hours at 210° C. under a reduced pressure.

Thus, a polyester resin (d) was prepared. The physical properties of the polyester resin (d) are as follows.

Content of components having molecular weight of not greater than 500: 3.5%

Peak molecular weight: 7500

Glass transition temperature (Tg): 62° C.

Mw/Mn ratio: 5.1

Acid value: 2.3 mgKOH/g

Temperature at which the resin has apparent viscosity of 103 Pa·s: 112° C.

Synthesis Example 5

Synthesis of Polyester Resin (e)

The procedure for preparation of the polyester resin (d) was repeated except that the following components were used and the reaction times for the first and second reactions were shortened.

| | |
|---|---|
| Polyoxypropylene(2.2)-2,2-bis(4-hydroxyphenyl)propane | 650 g |
| Polyoxyethylene(2.2)-2,2-bis(4-hydroxyphenyl)propane | 650 g |
| Isophthalic acid | 515 g |
| Isooctenysuccinic anhydride | 70 g |
| 1,2,4-benzenetricarboxylic acid | 80 g |

In addition, an esterification catalyst was also added thereto.

Thus, a polyester resin (e) was prepared. The physical properties of the polyester resin (e) are as follows.

Content of components having molecular weight of not greater than 500: 3.8%

Peak molecular weight: 3500

Glass transition temperature (Tg): 61° C.

Mw/Mn ratio: 2.7

Acid value: 9.0 mgKOH/g

Temperature at which the resin has apparent viscosity of 103 Pa·s: 117° C.

Synthesis Example 6

Synthesis of Polyester Resin (f)

The procedure for preparation of the polyester resin (e) was repeated except that the reaction times for the first and second reactions were the same as those in Synthesis Example 4.

Thus, a polyester resin (f) was prepared. The physical properties of the polyester resin (f) are as follows.

Content of components having molecular weight of not greater than 500: 2.1%

Peak molecular weight: 8800

Glass transition temperature (Tg): 61° C.

Mw/Mn ratio: 4.6

Acid value: 10.0 mgKOH/g

Temperature at which the resin has apparent viscosity of 103 Pa·s: 117° C.

Synthesis Example 7

Synthesis of Polyester Resin (g)

The procedure for preparation of the polyester resin (d) was repeated except that the following components were used and the reaction times for the first and second reactions were shortened.

| | |
|---|---|
| Polyoxypropylene(2.2)-2,2-bis(4-hydroxyphenyl)propane | 714 g |
| Polyoxyethylene(2.2)-2,2-bis(4-hydroxyphenyl)propane | 663 g |
| Isophthalic acid | 648 g |
| Isooctenysuccinic anhydride | 150 g |

In addition, an esterification catalyst was also added thereto.

Thus, a polyester resin (g) was prepared. The physical properties of the polyester resin (g) are as follows.

Content of components having molecular weight of not greater than 500: 4.8%

Peak molecular weight: 8500

Glass transition temperature (Tg): 67° C.

Mw/Mn ratio: 8.5

Acid value: 23.2 mgKOH/g

Temperature at which the resin has apparent viscosity of 103 Pa·s: 126° C.

Toner Preparation Examples 29-38

Preparation of Toner Particles J-R

The procedure for preparation of the toner particles A in Toner Preparation Example 1 was repeated except that the formula of the toner was changed as described in Table 12.

TABLE 12

| | Polyester resin | | Charge controlling agent | |
|---|---|---|---|---|
| Toner particles | Polyester | Added amount (parts by weight) | BONTRON | Added amount (parts by weight) |
| J | (d) | 100 | E-84 | 2.0 |
| K | (d) | 100 | E-84 | 3.0 |
| L | (e) | 100 | E-84 | 1.5 |
| M | (e) | 100 | E-84 | 2.0 |
| N | (f) | 100 | X-11 | 3.0 |
| P | (g) | 100 | E-84 | 2.0 |
| Q | (f) | 100 | E-84 | 4.0 |
| R | (d) | 100 | None | — |

Preparation of Toner 29 to 38

The procedure for preparation of the toner T1 in Toner Preparation Example 1 was repeated except that the formula of the toner was changed as described in Table 13.

Thus, toners T29-T38 were prepared. The properties of the toners are shown in Table 14.

TABLE 13

| | Toner particles | | External additive 1 | | External additive 2 | |
|---|---|---|---|---|---|---|
| Toner | Toner particles | Added amount (parts by weight) | Additive | Added amount (parts by weight) | Additive | Added amount (parts by weight) |
| T29 | J | 100 | H-2000 | 1.8 | RX-50 | 1.2 |
| T30 | J | 100 | H-2000 | 1.2 | RX-50 | 0.5 |
| T31 | K | 100 | H-2000 | 1.5 | RY-50 | 1.0 |
| T32 | K | 100 | H-2000 | 1.2 | RY-50 | 1.8 |
| T33 | L | 100 | H-2000 | 1.6 | RX-50 | 0.5 |
| T34 | M | 100 | H-3004 | 1.2 | RX-50 | 0.6 |
| T35 | N | 100 | H-3004 | 1.8 | RX-50 | 1.2 |
| T36 | P | 100 | H-2000 | 2.3 | None | — |
| T37 | Q | 100 | H-2000 | 1.5 | RY-50 | 0.8 |
| T38 | R | 100 | H-2000 | 2.8 | RX-50 | 1.0 |

Note:
The details of the external additives are as follows.
H-2000: Silica from Clariant Japan K.K., which has a BET specific surface area of 120 $m^2/g$.
H-3004: Silica from Clariant Japan K.K., which has a BET specific surface area of 200 $m^2/g$.
RX-50: Silica from Nippon Aerosil Co., which has a BET specific surface area of 50 $m^2/g$.
RY-50: Silica from Nippon Aerosil Co., which has a BET specific surface area of 50 $m^2/g$.

TABLE 14

| | Charge quantity distribution parameter | | |
|---|---|---|---|
| Toner | A*1 | B*1 | A/B |
| T29 | 3200 | 3130 | 1.02 |
| T30 | 2350 | 2390 | 0.98 |
| T31 | 2720 | 3010 | 0.90 |
| T32 | 2970 | 3220 | 0.92 |
| T33 | 2640 | 2030 | 1.30 |
| T34 | 2570 | 2010 | 1.28 |
| T35 | 3250 | 2240 | 1.45 |
| T36 | 3400 | 2220 | 1.53 |
| T37 | 2660 | 2320 | 1.15 |
| T38 | 3150 | 4290 | 0.73 |

A*1: $\Sigma_{45° C.}[(q/d) \times C]/Wh$
B*1: $\Sigma_{25° C.}[(q/d) \times C]/Wh$ Examples 21-27

The procedure for evaluation of the toner T1 in Example 1 was repeated except that the developing device was replaced with one of developing devices U1 and U2 and the toner was replaced with one of the toners T29-T35 as described in Table 15. The evaluation methods are mentioned below. The evaluation results are shown in Table 16.

Comparative Examples 16-18

The procedure for evaluation of the toner T1 in Example 1 was repeated except that the developing device was replaced with one of developing devices U1 and U2, and the toner was replaced with one of the toners T36-T38 as described in Table 15. The evaluation methods are mentioned below. The evaluation results are shown in Table 16.

The developing devices U1 and U2 are as follows.

Developing Device U1

The developing device U1 has a structure as illustrated in FIG. 16, and includes a developing unit 31 including a rotating member 31*d* configured to agitate and transport the toner therein, and the control valve 34 which can be bent by being contacted with the rotating member 31*d* and then returned when the rotating member 31*d* is separated therefrom, resulting in acceleration of transportation of the toner to the hopper. In addition, the developing unit includes a toner cartridge 32 having a rotating member 32*a* configured to agitate and transport the toner therein and a rib 35 serving as a toner return promoter.

Developing Device U2

The developing device U2 does not has the control valve 34, and includes an elastic check valve configured to prevent the toner in the developing unit from being fed back to the toner cartridge.

TABLE 15

| | Developing device | Toner | Volume ratio of developer in hopper (%) | A/B |
|---|---|---|---|---|
| Ex. 21 | U1 | T29 | 50 | 1.02 |
| Ex. 22 | U1 | T30 | 60 | 0.98 |
| Ex. 23 | U1 | T31 | 65 | 0.90 |
| Ex. 24 | U1 | T32 | 55 | 0.92 |
| Ex. 25 | U1 | T33 | 40 | 1.30 |
| Ex. 26 | U1 | T34 | 30 | 1.28 |

TABLE 15-continued

| | Developing device | Toner | Volume ratio of developer in hopper (%) | A/B |
|---|---|---|---|---|
| Ex. 27 | U1 | T35 | 45 | 1.45 |
| Comp. Ex. 16 | U2 | T36 | 85 | 1.53 |
| Comp. Ex. 17 | U2 | T37 | 95 | 1.15 |
| Comp. Ex. 18 | U1 | T38 | 35 | 0.73 |

TABLE 16

| | At beginning of running test | | After running test | | | High Temp. Condition | Over all |
|---|---|---|---|---|---|---|---|
| | BD | WS | BD | WS | Film | BD | Jud. |
| Ex. 21 | 0.00 | ○ | 0.01 | ○ | ○ | 0.01 | ◎ |
| Ex. 22 | 0.00 | ○ | 0.02 | ○ | ○ | 0.02 | ○ |
| Ex. 23 | 0.00 | ○ | 0.01 | Δ | ○ | 0.05 | Δ |
| Ex. 24 | 0.00 | ○ | 0.01 | ○ | ○ | 0.05 | Δ |
| Ex. 25 | 0.01 | ○ | 0.03 | ○ | ○ | 0.01 | ○ |
| Ex. 26 | 0.00 | Δ | 0.02 | Δ | ○ | 0.02 | ○ |
| Ex. 27 | 0.01 | ○ | 0.01 | ○ | ○ | 0.07 | Δ |
| Comp. Ex. 16 | 0.02 | ○ | 0.12 | X | Δ | 0.08 | X |
| Comp. Ex. 17 | 0.03 | Δ | 0.25 | X | Δ | 0.09 | X |
| Comp. Ex. 18 | 0.01 | ○ | 0.09 | Δ | Δ | 0.11 | Δ |

It is clear from Table 16 that the developing devices of Examples 21-27 can produce images without background fouling and white streaks and do not cause the filming problem even after long repeated use. Particularly, the developing device of Example 21 provides excellent performance.

In contrast, the developing devices of Comparative Examples 16 and 17, which use a check valve instead of the valve, cause the background fouling problem, and the white streak problem after long repeated use although the developing devices do not cause the problems at the beginning of the running test.

In the developing device of Comparative Example 18, in which the ratio A/B is slightly lower than the lower limit thereof, the background density slightly increases, and slight filming is caused after long repeated use although the developing devices do not cause the problems at the beginning of the running test.

This document claims priority and contains subject matter related to Japanese Patent Applications Nos. 2005-131712, 2005-131109 and 2005-133497, each filed on Apr. 28, 2005, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus, comprising:

an image bearing member configured to bear an electrostatic image thereon; and a developing device configured to develop the electrostatic image with a toner to form a toner image on the image bearing member, wherein the developing device includes a developing unit configured to develop the electrostatic image, the developing unit including a hopper configured to temporarily store toner supplied from a toner cartridge to the developing unit, and a first rotating member to form a first space in the toner supplied to the developing unit, and the toner cartridge configured to contain the toner and supply the toner to the developing unit through at least one opening, the toner cartridge including a second rotating member to form a second space in the toner contained in the toner cartridge, wherein the developing device circulates the toner contained in the toner cartridge with the toner supplied to the developing unit when the second rotating member presses part of the toner contained in the toner cartridge into the first space formed in the developing unit by the first rotating member while the second rotating member presses the part of the toner contained in the toner cartridge, and the first rotating member presses part of the toner supplied to the developing unit into the second space formed in the toner cartridge by the second rotating member while the first rotating member presses the part of the toner supplied to the developing unit, and wherein the developing device satisfies the following relationship:

$$T_H > T_C$$

wherein $T_H$ represents an internal temperature of the hopper, and $T_C$ represents an internal temperature of the toner cartridge.

2. The image forming apparatus according to claim 1, wherein the toner supplied to the developing unit is present in the hopper in an amount of from 30 to 80% by volume based on a volume of the hopper.

3. The image forming apparatus according to claim 1, wherein the toner comprises a binder resin, and a charge controlling agent which is dispersed in the binder resin.

4. The image forming apparatus according to claim 3, wherein the charge controlling agent is included in the toner in an amount of from 0.5 to 5.0% by weight based on total weight of the toner.

5. The image forming apparatus according to claim 3, wherein the charge controlling agent is a metal salicylate.

6. The image forming apparatus according to claim 3, wherein the binder resin comprises a polyester resin having an acid value of not greater than 20 mgKOH/g.

7. The image forming apparatus according to claim 3, wherein the toner further comprises:

at least one external additive in an amount of from 1.3 to 3.2 parts by weight per 100 parts by weight of toner particles to which the at least one external additive is added.

8. The image forming apparatus according to claim 3, wherein the toner further comprises:

at least two kinds of external additives having different average particle diameters, and wherein each of the at least two kinds of external additives is included in the toner in an amount of from 0.1 to 3.0 parts by weight per 100 parts by weight of toner particles to which the at least two kinds of external additives are added.

9. The image forming apparatus according to claim 1, wherein particles of the toner present on a background portion of the toner image formed on the image bearing member has an optical density of less than 0.01.

10. The image forming apparatus according to claim 1, wherein the toner cartridge comprises:

the second rotating member configured to agitate and transport the toner contained in the toner cartridge, and a toner return promoting member configured to accelerate return of the toner supplied to the developing unit to the toner cartridge by formation of the second space in the toner cartridge in a vicinity of the at least one opening together with the second rotating member, and wherein the toner has a powder wall collapsing angle of from 30 to 70°.

11. The image forming apparatus according to claim 10, wherein the second rotating member comprises a bendable blade.

12. The image forming apparatus according to claim 10, wherein the toner return promoting member comprises a plate located on an inner surface of the toner cartridge.

13. The image forming apparatus according to claim 10, wherein the toner has an aggregation rate of from 6 to 15%.

14. The image forming apparatus according to claim 10, wherein the toner has a bulk density of from 0.35 to 0.50.

15. The image forming apparatus according to claim 1, wherein the hopper comprises:

the first rotating member configured to agitate and transport the toner supplied to the developing unit, and a toner supply promoting member configured to accelerate to supply the toner contained in the toner cartridge to the hopper through the at least one opening by formation of the first space in the hopper when contacted with the first rotating member, and then released from the first rotating member, wherein the toner has a powder wall collapsing angle of from 5 to 50°.

16. The image forming apparatus according to claim 15, wherein the toner supply promoting member also serves as a toner return promoting member configured to push out part of the toner supplied to the developing unit which is in the hopper to the toner cartridge through the at least one opening when pressed by the first rotating member.

17. The image forming apparatus according to claim 15, wherein the toner supply promoting member comprises a bendable valve.

18. The image forming apparatus according to claim 17, wherein the bendable valve is bent by the first rotating member.

19. The image forming apparatus according to claim 17, wherein the bendable valve is located in a vicinity of the at least one opening.

20. The image forming apparatus according to claim 15, wherein the toner has an aggregation rate of from 4 to 12%.

21. The image forming apparatus according to claim 15, wherein the toner has a bulk density of from 0.30 to 0.45.

22. A developing device to develop an electrostatic latent image with a toner to form a toner image, comprising:

a developing unit configured to develop the electrostatic latent image, the developing unit including a hopper configured to temporarily store toner fed from a toner cartridge to the developing unit, and a first rotating member to form a first space in the toner fed to the developing unit; and the toner cartridge configured to supply the toner to the developing unit through at least one opening, the toner cartridge including a second rotating member to form a second space in the toner contained in the toner cartridge, wherein the developing device circulates the toner contained in the toner cartridge with the toner fed to the developing unit when the second rotating member presses part of the toner contained in the toner cartridge into the first space formed in the developing unit by the first rotating member while the second rotating member presses the part of the toner contained in the toner cartridge, and the first rotating member presses part of the toner fed to the developing unit into the second space formed in the toner cartridge by the second rotating member while the first rotating member presses the part of the toner fed to the developing unit, and wherein the developing device satisfies the following relationship:

$$T_H > T_C$$

wherein $T_H$ represents an internal temperature of the hopper, and $T_C$ represents an internal temperature of the toner cartridge.

23. The developing device according to claim 22, wherein the toner cartridge comprises:

the second rotating member configured to agitate and transport the toner contained in the toner cartridge, and a toner return promoting member configured to accelerate return of the toner fed to the developing unit to the toner cartridge by formation of the second space in the toner cartridge in a vicinity of the at least one opening together with the second rotating member, and wherein the toner has a powder wall collapsing angle of from 30 to 70°.

24. The developing device according to claim 22, wherein the hopper comprises:

the first rotating member configured to agitate and transport the toner fed to the developing unit, and a toner supply promoting member configured to accelerate to supply the toner contained in the toner cartridge to the hopper through the at least one opening by formation of the first space in the hopper when contacted with the first rotating member, and then released from the first rotating member, wherein the toner has a powder wall collapsing angle of from 5 to 50°.

25. A process cartridge, comprising:

an image bearing member configured to bear an electrostatic latent image thereon; and a developing device configured to develop the electrostatic latent image with a toner to form a toner image, wherein the developing device includes a developing unit configured to develop the electrostatic latent image, the developing unit including a hopper configured to temporarily store toner fed from a toner cartridge to the developing unit, and a first rotating member to form a first space in the toner fed to the developing unit, and the toner cartridge configured to supply the toner to the developing unit through at least one opening, the toner cartridge including a second rotating member to form a second space in the toner contained in the toner cartridge, wherein the developing device circulates the toner contained in the toner cartridge with the toner fed to the developing unit when the second rotating member presses part of the toner contained in the toner cartridge into the first space formed in the developing unit by the first rotating member while the second rotating member presses the part of the toner contained in the toner cartridge, and the first rotating member presses part of the toner fed to the developing unit into the second space formed in the toner cartridge by the second rotating member while the first rotating member presses the part of the toner fed to the developing unit, and wherein the developing device satisfies the following relationship:

$$T_H > T_C$$

wherein $T_H$ represents an internal temperature of the hopper, and $T_C$ represents an internal temperature of the toner cartridge, and wherein the process cartridge is detachably attached to an image forming apparatus as a unit.

26. The process cartridge according to claim 25, wherein the toner cartridge comprises:

the second rotating member configured to agitate and transport the toner contained in the toner cartridge, and a toner return promoting member configured to accelerate return of the toner fed to the developing unit to the toner cartridge by formation of the second space in the toner cartridge in a vicinity of the at least one opening together with the second rotating member, and wherein the toner has a powder wall collapsing angle of from 30 to 70°.

27. The process cartridge according to claim 25, wherein the hopper comprises:

the first rotating member configured to agitate and transport the toner fed to the developing unit, and a toner supply promoting member configured to accelerate to supply the toner contained in the toner cartridge to the hopper through the at least one opening by formation of the first space in the hopper when contacted with the first rotating member, and then released from the first rotating member, wherein the toner has a powder wall collapsing angle of from 5 to 50°.

28. An image forming method comprising:

forming an electrostatic image on an image bearing member;

developing the electrostatic image with a toner by forming a toner image on the image bearing member using a developing device; the developing step including supplying toner contained in a toner cartridge to a developing unit of the developing device through at least one opening;

and temporarily storing, in the developing unit, the toner supplied from the toner cartridge to the developing unit; and circulating the toner contained in the toner cartridge with the toner supplied to the developing unit by pressing, by a second rotating member, part of the toner contained in the toner cartridge into a first space formed in the developing unit by a first rotating member while the second rotating member presses the part of the toner contained in the toner cartridge, and pressing, by the first rotating member, part of the toner supplied to the developing unit into a second space formed in the toner cartridge by the second rotating member while the first rotating member presses the part of the toner supplied to the developing unit, wherein the developing device satisfies the following relationship:

$$T_H > T_C$$

wherein $T_H$ represents an internal temperature of the hopper, and $T_C$ represents an internal temperature of the toner cartridge.

29. The image forming apparatus according to claim 1, wherein the toner satisfies the following relationship $$0.9 < CQDP_{45^\circ C.}/CQDP_{25^\circ C.} < 1.5,$$

wherein $CQDP_{45^\circ C.}$ and $CQDP_{25^\circ C.}$ represent a charge quantity distribution parameter of the toner under a condition of 45° C. and 54% RH and a condition of 25° C. and 54% RH, respectively, and wherein the charge quantity distribution parameter CQDP is determined by the following equation $$CQDP = \Sigma[(q/d) \times C]/Wh$$

wherein q represents a charge quantity of a toner particle in units of femto-coulomb, d represents a diameter of the toner particle in units often micrometers, C represents a number of toner particles having such a charge quantity and a particle diameter, and Wh represents a half width of a charge quantity distribution curve, wherein $\Sigma[(q/d) \times C]$ is greater than 7,000 and less than 12,000 under the conditions of 45° C. and 54% RH and 25° C. and 54% RH.

30. The image forming apparatus according to claim 29, wherein the toner satisfies the following relationship:

$$2{,}000 < CQDP_{45^\circ C.} < 5{,}000.$$

31. The image forming apparatus according to claim 29, wherein the toner satisfies the following relationship:

$$2{,}000 < CQDP_{25^\circ C.} < 5{,}000.$$

32. The image forming apparatus according to claim 29, wherein the half width (Wh) is from 1.0 to 3.5.

* * * * *